US009886820B2

(12) United States Patent
Arnone et al.

(10) Patent No.: US 9,886,820 B2
(45) Date of Patent: Feb. 6, 2018

(54) DIFFERENCE ENGINE HYBRID GAME

(71) Applicant: Gamblit Gaming, LLC, Glendale, CA (US)

(72) Inventors: Miles Arnone, Sherborn, MA (US); Frank Cire, Pasadena, CA (US); Eric Meyerhofer, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 15/396,354

(22) Filed: Dec. 30, 2016

(65) Prior Publication Data

US 2017/0109969 A1 Apr. 20, 2017

Related U.S. Application Data

(63) Continuation of application No. 14/214,310, filed on Mar. 14, 2014, now Pat. No. 9,564,008, which is a (Continued)

(51) Int. Cl.
*G07F 17/32* (2006.01)

(52) U.S. Cl.
CPC ..... *G07F 17/3244* (2013.01); *G07F 17/3225* (2013.01)

(58) Field of Classification Search
CPC ..... A63F 13/00; A63F 13/12; A63F 9/24
(Continued)

(56) References Cited

U.S. PATENT DOCUMENTS 5,413,357 A 5/1995 Schulze et al.
5,718,429 A 2/1998 Keller
(Continued)

FOREIGN PATENT DOCUMENTS

JP 2001300098 A 10/2001
JP 2003111980 A 4/2003
(Continued)

OTHER PUBLICATIONS

U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015
U.S. Appl. No. 14/823,951 Arnone, et al. filed Aug. 11, 2015.
U.S. Appl. No. 14/822,890 Arnone, et al. filed Aug. 10, 2015.
U.S. Appl. No. 14/825,056 Arnone, et al. filed Aug. 11, 2015.
U.S. Appl. No. 14/835,590 Arnone, et al. filed Aug. 25, 2015.
U.S. Appl. No. 14/836,032 Arnone, et al. filed Aug. 26, 2015.
U.S. Appl. No. 14/839,647 Arnone, et al. filed Aug. 28, 2015.
(Continued)

*Primary Examiner* — David L Lewis
*Assistant Examiner* — Shauna-Kay Hall
(74) *Attorney, Agent, or Firm* — Caitlyn Ross

(57) ABSTRACT

Systems and methods in accordance with embodiments of the invention operate a difference engine hybrid game. The hybrid game includes a real world engine constructed to determine a randomly generated payout of real world credits from a wager in a gambling game, the payout determined using a paytable, an entertainment software engine constructed to execute an entertainment game providing one or more entertainment game variables based upon skillful execution of the entertainment game involving at least one player action, and a game world engine constructed to manage the entertainment software engine and communicate gameplay gambling event occurrences based upon skillful execution of the entertainment game involving the at least one player action that trigger a wager in the gambling game to the gambling game; wherein the game world engine utilizes a difference engine module constructed to determine the paytable of the real world engine used to determine the randomly generated payout, from among a plurality of paytables based on the one or more entertainment game variables of the entertainment game.

7 Claims, 15 Drawing Sheets

Related U.S. Application Data continuation of application No. PCT/US2013/038301, filed on Apr. 25, 2013.

(60) Provisional application No. 61/637,921, filed on Apr. 25, 2012.

(58) Field of Classification Search
USPC ..... 463/1, 7, 10, 16, 42
See application file for complete search history.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,648,760 B1 11/2003 Nicastro
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0160825 A1 10/2002 Nicastro et al.
2002/0175471 A1 11/2002 Faith
2003/0027619 A1 2/2003 Nicastro, Sr.
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0009816 A1* 1/2004 Miller ..... A63F 13/12 463/42
2004/0092313 A1 5/2004 Saito et al.
2004/0097610 A1 5/2004 Saito
2004/0102238 A1 5/2004 Taylor
2004/0116173 A1 6/2004 Baerlocher
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0066403 A1* 3/2007 Conkwright ..... A63F 13/10 463/43
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129139 A1* 6/2007 Nguyen ..... G07F 17/3262 463/25
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0081689 A1* 4/2008 Seelig ..... G07F 17/3202 463/23
2008/0096665 A1 4/2008 Cohen
2008/0108406 A1 5/2008 Oberberger
2008/0108425 A1 5/2008 Oberberger

(56) References Cited

U.S. PATENT DOCUMENTS

| | | | |
|---|---|---|---|
| 2008/0113704 | A1 | 5/2008 | Jackson |
| 2008/0119283 | A1 | 5/2008 | Baerlocher |
| 2008/0146308 | A1 | 6/2008 | Okada |
| 2008/0161081 | A1 | 7/2008 | Berman |
| 2008/0176619 | A1 | 7/2008 | Kelly |
| 2008/0191418 | A1 | 8/2008 | Lutnick et al. |
| 2008/0195481 | A1 | 8/2008 | Lutnick |
| 2008/0248850 | A1 | 10/2008 | Schugar |
| 2008/0254893 | A1 | 10/2008 | Patel |
| 2008/0274796 | A1 | 11/2008 | Lube |
| 2008/0274798 | A1 | 11/2008 | Walker et al. |
| 2008/0311980 | A1 | 12/2008 | Cannon |
| 2008/0318668 | A1 | 12/2008 | Ching |
| 2009/0011827 | A1 | 1/2009 | Englman |
| 2009/0023489 | A1 | 1/2009 | Toneguzzo |
| 2009/0023492 | A1 | 1/2009 | Erfanian |
| 2009/0061974 | A1 | 3/2009 | Lutnick et al. |
| 2009/0061975 | A1 | 3/2009 | Ditchev |
| 2009/0061991 | A1 | 3/2009 | Popovich |
| 2009/0061997 | A1 | 3/2009 | Popovich |
| 2009/0061998 | A1 | 3/2009 | Popovich |
| 2009/0061999 | A1 | 3/2009 | Popovich |
| 2009/0082093 | A1 | 3/2009 | Okada |
| 2009/0088239 | A1 | 4/2009 | Iddings |
| 2009/0098934 | A1 | 4/2009 | Amour |
| 2009/0118006 | A1 | 5/2009 | Kelly et al. |
| 2009/0124344 | A1 | 5/2009 | Mitchell et al. |
| 2009/0131158 | A1 | 5/2009 | Brunet De Courssou et al. |
| 2009/0131175 | A1 | 5/2009 | Kelly et al. |
| 2009/0143141 | A1 | 6/2009 | Wells |
| 2009/0149233 | A1 | 6/2009 | Strause et al. |
| 2009/0156297 | A1 | 6/2009 | Andersson et al. |
| 2009/0176560 | A1 | 7/2009 | Herrmann et al. |
| 2009/0176566 | A1 | 7/2009 | Kelly |
| 2009/0181777 | A1 | 7/2009 | Christiani |
| 2009/0221355 | A1 | 9/2009 | Dunaevsky et al. |
| 2009/0239610 | A1 | 9/2009 | Olive |
| 2009/0247272 | A1 | 10/2009 | Abe |
| 2009/0270164 | A1 | 10/2009 | Seelig |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham et al. |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0285869 | A1 | 11/2010 | Walker |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0039621 | A1 | 2/2011 | Steene et al. |
| 2011/0045896 | A1 | 2/2011 | Sak et al. |
| 2011/0070945 | A1 | 3/2011 | Walker |
| 2011/0077087 | A1 | 3/2011 | Walker et al. |
| 2011/0082571 | A1 | 4/2011 | Murdock et al. |
| 2011/0105206 | A1 | 5/2011 | Rowe et al. |
| 2011/0107239 | A1 | 5/2011 | Adoni |
| 2011/0109454 | A1 | 5/2011 | McSheffrey |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0294561 | A1 | 12/2011 | Shaw et al. |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302311 | A1 | 11/2012 | Luciano |
| 2012/0322545 | A1 | 12/2012 | Arnone et al. |
| 2013/0029760 | A1 | 1/2013 | Wicket |
| 2013/0053118 | A1 | 2/2013 | Schueller |
| 2013/0131848 | A1 | 5/2013 | Arnone et al. |
| 2013/0190074 | A1 | 7/2013 | Arnone et al. |
| 2013/0260869 | A1 | 10/2013 | Leandro et al. |
| 2014/0087801 | A1 | 3/2014 | Nicely et al. |
| 2014/0087808 | A1 | 3/2014 | Leandro et al. |
| 2014/0087809 | A1 | 3/2014 | Leupp et al. |
| 2014/0357350 | A1 | 12/2014 | Weingardt et al. |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2011109454 | A1 | 9/2011 |
| WO | 2012139083 | A1 | 10/2012 |
| WO | 2013059308 | A1 | 4/2013 |

OTHER PUBLICATIONS

U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 25, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.

(56) References Cited

OTHER PUBLICATIONS

U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/362,660 Arnone, et al. filed Dec. 9, 2016.
U.S. Appl. No. 15/365,628 Arnone, et al. filed Dec. 13, 2016.
U.S. Appl. No. 15/367,541 Arnone, et al. filed Dec. 14, 2016.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 11, 2016.
U.S. Appl. No. 14/799,481 Arnone, et al. filed Jul. 14, 2015.
U.S. Appl. No. 15/362,214 Arnone, et al. filed Dec. 7, 2016.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
International Search Report and Written Opinion, PCT/US2013/38301, dated Aug. 15, 2013.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.

(56) References Cited

OTHER PUBLICATIONS

U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
Itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/994,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.

* cited by examiner

DIFFERENCE ENGINE HYBRID GAME

CROSS REFERENCE TO RELATED APPLICATIONS

This application is a continuation of U.S. patent application Ser. No. 14/214,310, filed Mar. 14, 2014, which is a continuation of Patent Cooperation Treaty Application No. PCT/US13/38301, filed Apr. 25, 2013 which claims the benefit of U.S. Provisional Patent Application No. 61/637,921 filed on Apr. 25, 2012, the contents of each of which are hereby incorporated by reference in their entirety as if stated in full herein.

FIELD OF THE INVENTION

Embodiments of the present invention are generally related to gaming and more specifically to difference engine hybrid games that include both an entertainment game and a gambling game where a player's performance in the entertainment game is used to affect a choice of paytables in the gambling game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game can depend upon a player's skill with the game. Gambling games are typically not as interactive and do not include graphics as sophisticated as an entertainment game, which is a game of skill such as a video game.

SUMMARY OF THE INVENTION

Systems and methods in accordance with embodiments of the invention operate a difference engine hybrid game. In one embodiment, a hybrid game includes an entertainment software engine constructed to: execute an entertainment game of skill; provide one or more entertainment game variables that affect a player's skillful play of the entertainment game involving one or more player actions; and generate one or more entertainment game outcomes on the basis of the one or more player actions. The hybrid game further includes a real world engine constructed to provide one or more randomly generated outcomes of real world credits for one or more wagers of real world credits, wherein an amount of real world credits of the one or more randomly generated outcomes is determined using a paytable. The hybrid game further includes a game world engine coupled to the entertainment software engine and the real world engine, wherein the game world engine is constructed to: determine an amount of game world credits awarded to the player on the basis of the one or more entertainment game outcomes; determine the paytable of the real world engine from among a plurality of paytables on the basis of the one or more entertainment game variables of the entertainment game and the amount of game world credits awarded to the player; determine one or more gambling event occurrences based upon the one or more player actions; and trigger the one or more wagers of real world credits in the real world engine on the basis of the determined one or more gambling event occurrences.

In some embodiments, the one or more entertainment game variables are one or more player entertainment game play metrics.

In many embodiments, the game world engine is further constructed to compare the entertainment game variables to a baseline state against which performance of the player is compared in order to determine the paytable from among the plurality of paytables.

In various embodiments, the game world engine is further constructed to use a Euclidian distance to compare the one or more entertainment game variables to the baseline state.

In numerous embodiments, the baseline state is a standard of player performance for a plurality of players.

In some embodiments, the baseline state is an optimal amount of game world credit.

In one embodiments, a method of operating a hybrid game is provided. The method includes executing by one or more processors a process including: executing an entertainment game of skill; providing one or more entertainment game variables that affect a player's skillful play of the entertainment game involving one or more player actions; generating one or more entertainment game outcomes on the basis of the one or more player actions; determining an amount of game world credits on the basis of the one or more entertainment game outcomes; determining a paytable from among a plurality of paytables on the basis of the one or more entertainment game variables of the entertainment game and the amount of game world credits; determining one or more gambling event occurrences based upon the one or more player actions; triggering one or more wagers of real world credits on the basis of the determined one or more gambling event occurrences; and generating one or more randomly generated outcomes of real world credits for the one or more wagers of real world credits, wherein an amount of real world credits of the one or more randomly generated outcomes is determined using the paytable.

In some embodiments, a non-transitory machine-readable medium containing processor instructions is provided. Execution of the instructions by one or more processors causes the one or more processors to perform a process of a hybrid game, the process including: executing an entertainment game of skill; providing one or more entertainment game variables that affect a player's skillful play of the entertainment game involving one or more player actions; generating one or more entertainment game outcomes on the basis of the one or more player actions; determining an amount of game world credits on the basis of the one or more entertainment game outcomes; determining a paytable from among a plurality of paytables on the basis of the one or more entertainment game variables of the entertainment game and the amount of game world credits; determining one or more gambling event occurrences based upon the one or more player actions; triggering one or more wagers of real world credits on the basis of the determined one or more gambling event occurrences; and generating one or more randomly generated outcomes of real world credits for the one or more wagers of real world credits, wherein an amount of real world credits of the one or more randomly generated outcomes is determined using the paytable.

DETAILED DESCRIPTION

Figure 1:
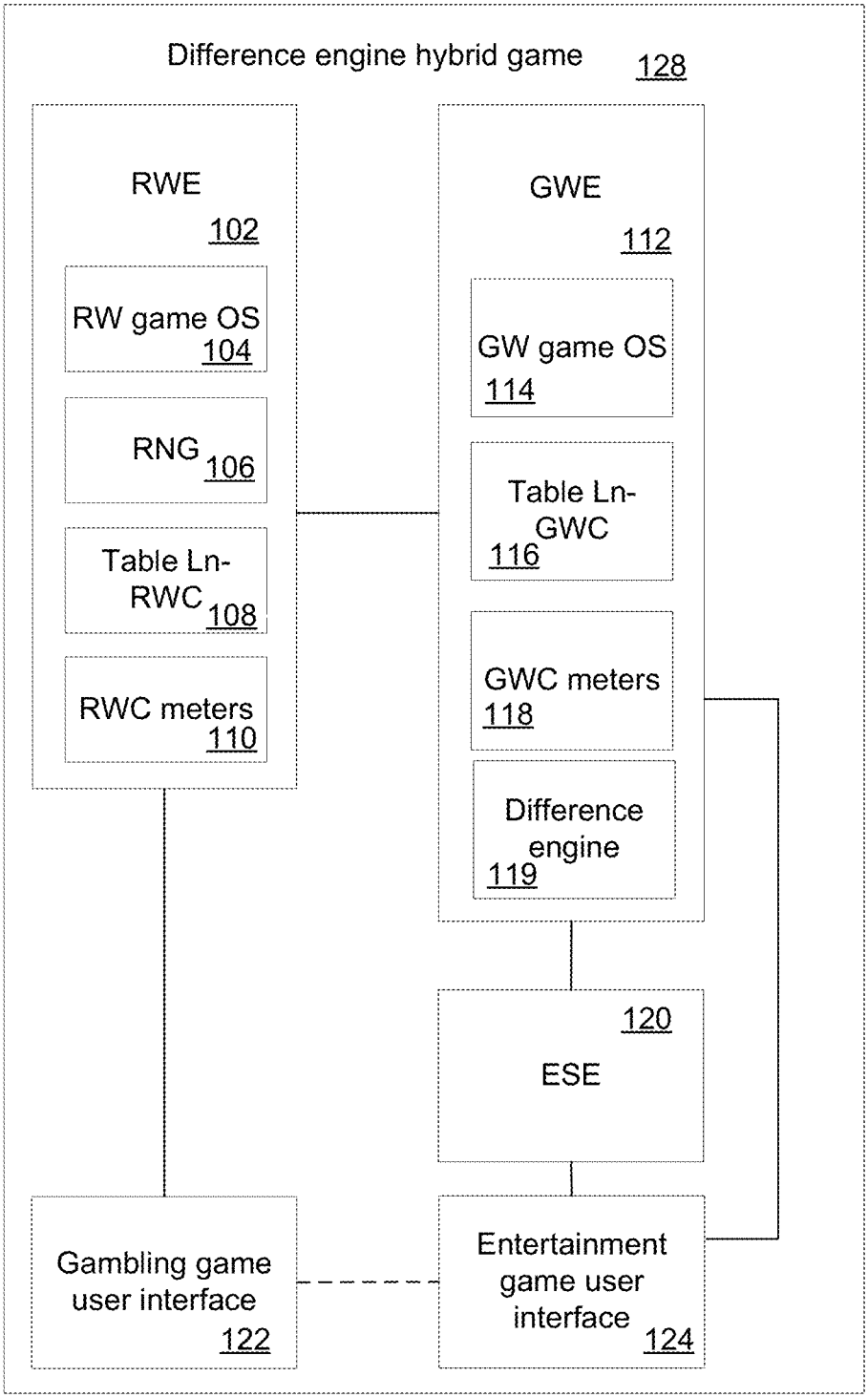
FIG. 1 illustrates a difference engine hybrid game in accordance with an embodiment of the invention.

Turning now to the drawings, systems and methods for operation of difference engine hybrid games are illustrated. In several embodiments, a difference engine hybrid game is a form of a difference engine hybrid game that integrates a difference engine module with both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the difference engine hybrid game also includes a user interface associated with either or both the gambling game and the entertainment game. A player of a difference engine hybrid game is the electronic representation of interactions, typically via a user interface, associated with a player profile of the difference engine hybrid game. In operation of a difference engine hybrid game, a player acts upon various types of elements of the entertainment game in a game world environment. Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world objects, experience points, skill points, or points generally that are awarded or earned by the player for the player's play of the entertainment game. Wagers are made in the gambling game using real world credits (RWC). The real world credits can be credits in an actual currency, or can be credits in a virtual currency which has real world value. Gambling outcomes from the gambling game can cause consumption, loss or accrual of RWC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RWC value if cashed out of a difference engine hybrid game gameplay session. Example elements include enabling elements (EE) which are elements that enable a player's play of the entertainment game and whose consumption by the player while playing the entertainment game can trigger a wager in a gambling game. Another example of an element is a reserve enabling element (REE), which is an element that converts into one or more enabling elements upon occurrence of a release event in a difference engine hybrid game gameplay. Other types of elements include actionable elements (AE) which are elements that are acted upon to trigger a wager in the gambling game and cannot be restorable during normal play of the entertainment game. In progressing through entertainment game gameplay, elements can be utilized by a player during interactions with a controlled entity (CE) which is a character, entity, inanimate object, device or other object under control of a player. Also, entertainment game gameplay progress can be dependent upon: a required object (RO) which is a specific object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RWC and elements are discussed above, any gameplay resource can be utilized to advance difference engine hybrid game gameplay as appropriate to the specification of a specific application in accordance with embodiments of the invention. Various hybrid games are discussed in Patent Cooperation Treaty Application No. PCT/US11/26768, filed Mar. 1, 2011, entitled ENRICHED GAME PLAY ENVIRONMENT (SINGLE and/or MULTIPLAYER) FOR CASINO APPLICATIONS and Patent Cooperation Treaty Application No. PCT/US11/63587, filed Dec. 6, 2011, entitled ENHANCED SLOT-MACHINE FOR CASINO APPLICATIONS each disclosure of which is hereby incorporated by reference in its entirety.

In numerous embodiments, a difference engine module can be implemented locally on a difference engine hybrid game within the GWE, remotely on an difference engine server accessible to a difference engine hybrid game via a network, or as a distributed system where processes of a difference engine module occur locally on a difference engine hybrid game and on a remote server.

Difference engine hybrid games in accordance with embodiments of the invention are discussed below.

Difference Engine Hybrid Games

In many embodiments, a difference engine hybrid game integrates high-levels of entertainment content with a game of skill (entertainment game), a gambling experience with a game of chance (gambling game). A difference engine hybrid game provides for random outcomes independent of player skill while providing that the user's gaming experience (as measured by obstacles/challenges encountered, time of play and other factors) is shaped by the player's skill. The difference engine hybrid game can also utilize a difference engine module to determine a payout table based on a player's skill in playing the entertainment game. A difference engine hybrid game in accordance with an embodiment of the invention is illustrated in FIG. 1. The difference engine hybrid game 128 includes a RWE 102, GWE 112, ESE 120, gambling game user interface 122 and entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the difference engine hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator or pseudo random number generator (RNG) 106, level n real-world credit pay tables (Table Ln-RWC) 108, RWC meters 110 and other software constructs that enable a game of chance to offer a fair and transparent gambling proposition, and to contain the auditable systems and processes that can enable the game to obtain gaming regulatory body approval.

A random number generator or pseudo random number generator (RNG) 106 includes software and/or hardware algorithms and/or processes, which are used to generate random outcomes. A level n real-world credit pay table (Table Ln-RWC) 108 is a table that can be used in conjunction with a random number generator (RNG) 106 to dictate the real world credits (RWC) earned as a function of sponsored gameplay and is analogous to the pay tables used in a conventional slot machine. Table Ln-RWC payouts are independent of player skill. There can be one or a plurality of Table Ln-RWC pay tables 108 contained in a gambling game, the selection of which can be determined by factors including (but not limited to) game progress a player has earned, and/or bonus rounds which a player can be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be used as criteria in order to enter higher ESE game levels. RWC can be carried forward to higher game levels or paid out if a cash out is opted for by a player. The amount of RWC used to enter a specific level of the game level n need not be the same for each level.

In many embodiments, the GWE 112 manages the overall difference engine hybrid game operation, with the RWE 102 and the ESE 120 effectively being support units to the GWE 112. In several embodiments, the GWE 112 contains mechanical, electronic and software system for an entertainment game. The GWE 112 includes an operating system (OS) 114 that provides control of the entertainment game. The GWE additionally contains a level n game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level n game world credit pay table (Table Ln-GWC) 116 dictates the GWC earned as a function of player skill in the nth level of the game. The payouts governed by this table are dependent upon player skill and sponsored gameplay at large and can or cannot be coupled to a random number generator. In several embodiments, game world credits (GWC) are player points earned or depleted as a function of player skill, specifically as a function of player performance in the context of the game. GWC is analogous to the score in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as by earning entrance into a sweepstakes drawing, or earning participation in, or victory in, a tournament with prizes. GWC can be stored on a player tracking card or in a network-based player tracking system, where the GWC is attributed to a specific player.

In certain embodiments, the operation of the GWE does not affect the RWE's gambling operation except for player choice parameters that are allowable in slot machines including but not limited to wager terms such as but not limited to a wager amount, how fast the player wants to play (by pressing a button or pulling the handle of a slot machine) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a difference engine hybrid game that is an electromechanical difference engine hybrid game. An electromechanical difference engine hybrid game executes an electromechanical game for player entertainment. The electromechanical game can be any game that utilizes both mechanical and electrical components, where the game operates as a combination of mechanical motions performed by at least one player or the electromechanical game itself. Various electromechanical difference engine hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special portion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose can include but is not limited to gameplay with a more powerful character, a more powerful gun, or a better car. These choices can increase or decrease the amount wagered per individual gambling game, in the same manner that a standard slot machine player can decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the difference engine hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a difference engine hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate gamers can be established with the entertainment game. In several embodiments, the difference engine hybrid game can leverage very popular titles with gamers and provides a sea change environment for casinos to attract players with games that are more akin to the type of entertainment that a younger generation desires. In various embodiments, players can use their skill towards building and banking GWC that in turn can be used to win tournaments and various prizes as a function of their gamer prowess. Numerous embodiments minimize the underlying changes needed to the aforementioned entertainment software for the difference engine hybrid game to operate within an entertainment game construct, thus making a plethora of complex game titles and environments, rapid and inexpensive to deploy in a gambling environment.

In certain embodiments, difference engine hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In many embodiments, one or more players engage in playing an entertainment game, resident in the ESE, the outcomes of which are dependent at least in part on skill. The difference engine hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
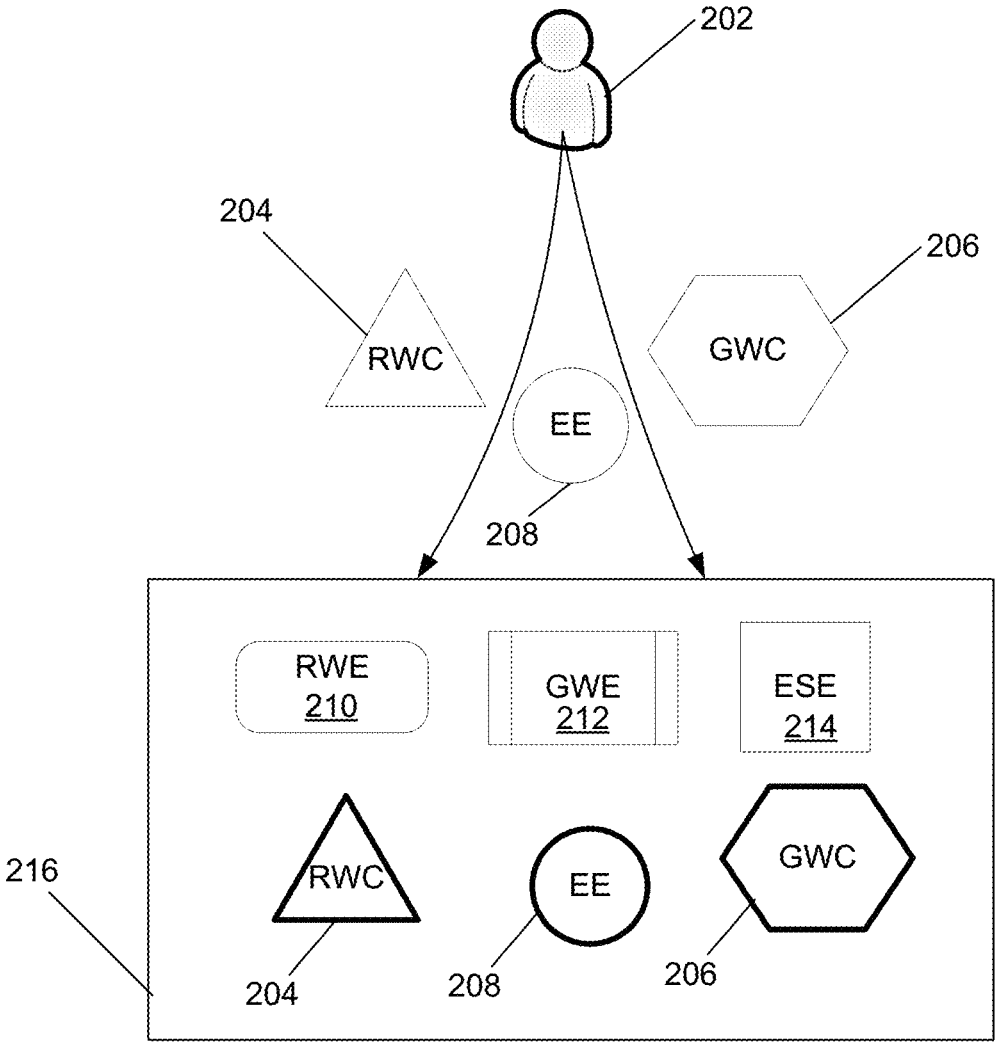
FIG. 2 is a conceptual diagram that illustrates how resources are utilized in a difference engine hybrid game in accordance with an embodiment of the invention.

In several embodiments, a player can interact with a difference engine hybrid game by using RWC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RWC and elements, such as but not limited to EE, are utilized in a difference engine hybrid game in accordance with an embodiment of the invention is illustrated in FIG. 2. The conceptual diagram illustrates that RWC 204, EE 208 and GWC 206 can be utilized by a player 202 in interactions with the RWE 210, GWE 212 and ESE 214 of a difference engine hybrid game 216. The contribution of elements, such as EE 208, can be linked to a player's access to credits, such as RWC 204 or GWC 206. Electronic receipt of these credits can come via a smart card, voucher or other portable media, or as received over a network from a server. In certain implementations, these credits can be drawn on demand from a player profile located in a database locally on a difference engine hybrid game or in a remote server.

Figure 3:
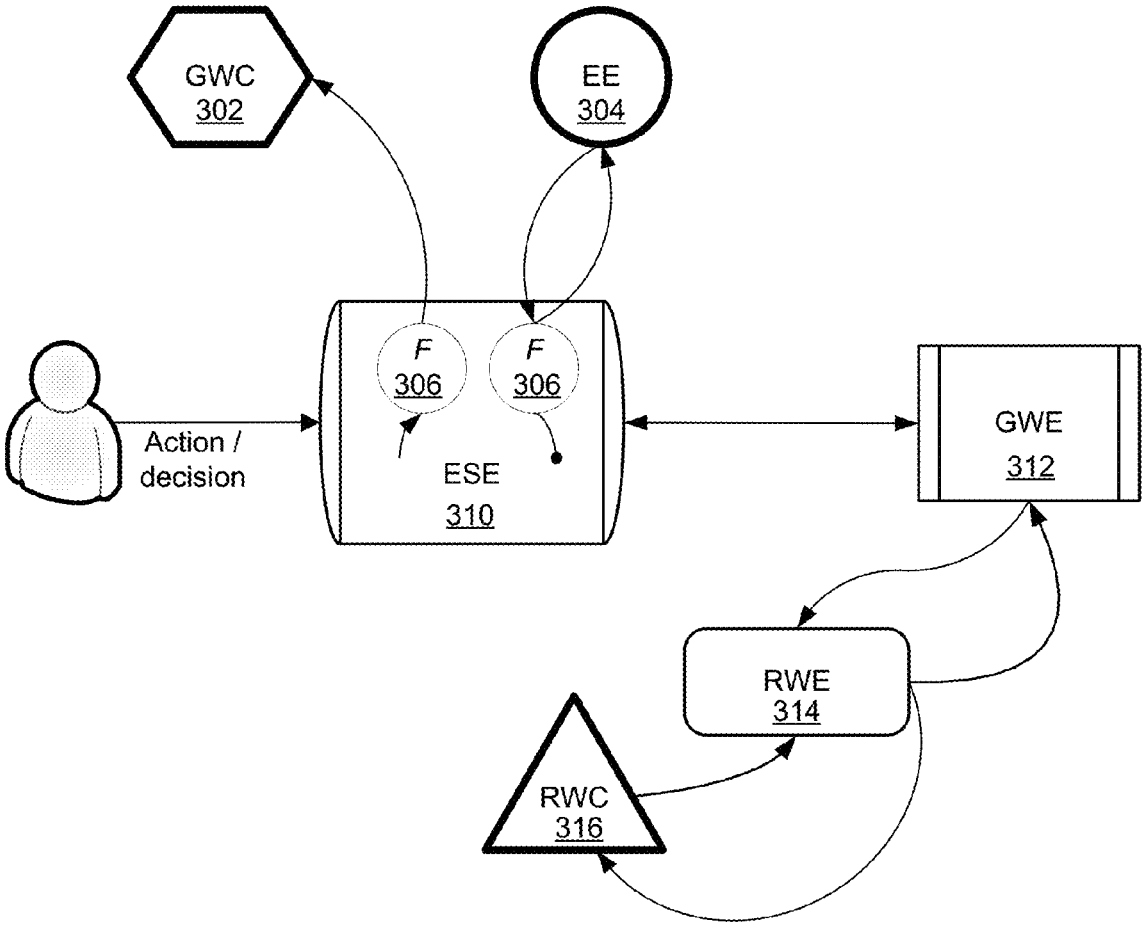
FIG. 3 is a conceptual diagram that illustrates interplay between resources and components of a difference engine hybrid game in accordance with an embodiment of the invention.

A conceptual diagram that illustrates interplay between elements and components of a difference engine hybrid game in accordance with an embodiment of the invention is illustrated in FIG. 3. Similar to FIG. 2, a player's actions and/or decisions can affect functions 306 that consume and/or accumulate GWC 302 and/or EE 304 in an entertainment game executed by an ESE 310. A GWE 312 can monitor the activities taking place within an entertainment game executed by an ESE 310 for gameplay gambling event occurrences. The GWE 312 can also communicate the gameplay gambling event occurrences to an RWE 314 that triggers a wager of RWC 316 in a gambling game executed by the RWE 314.

Figure 4:
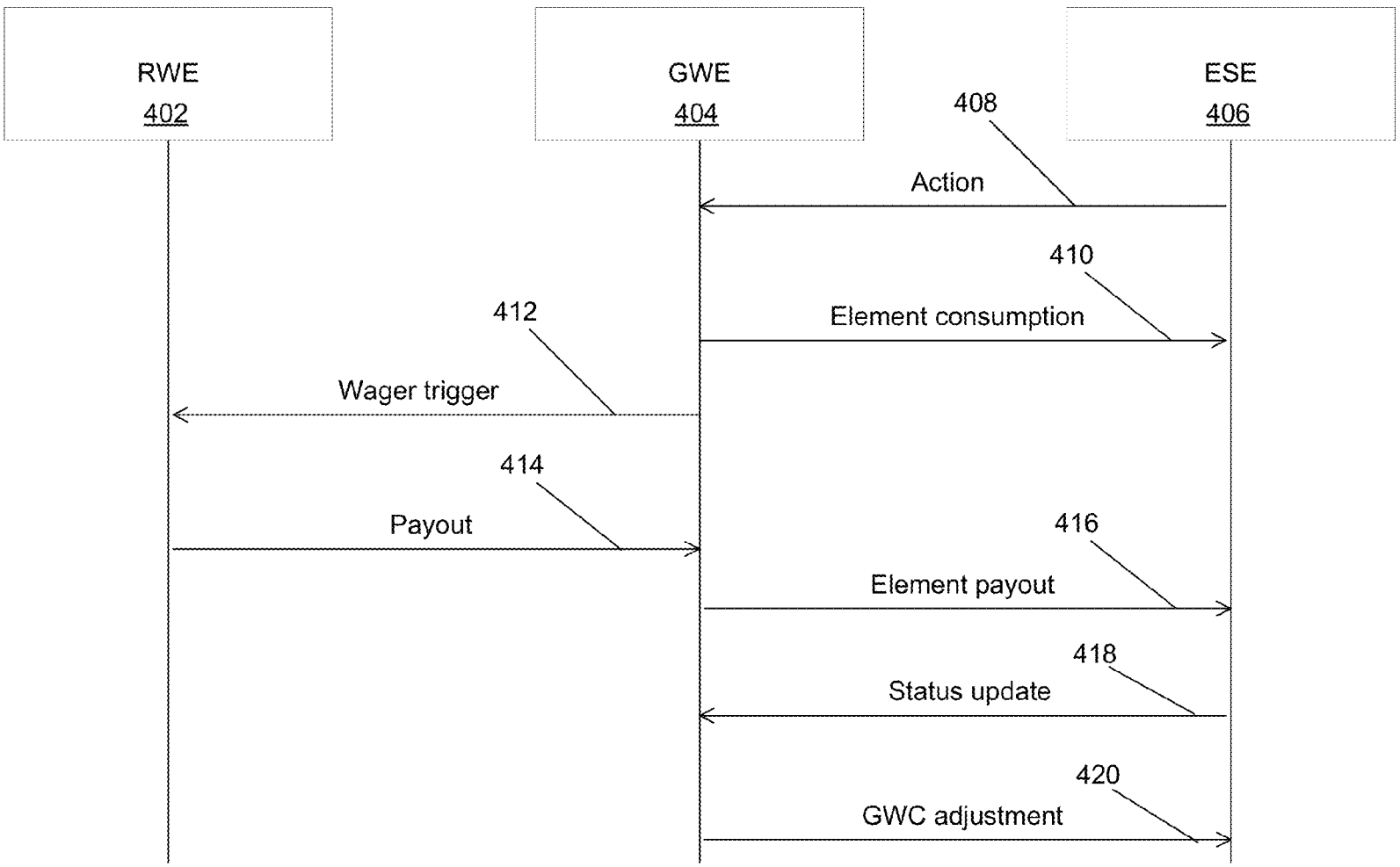
FIG. 4 is a timing diagram that illustrates a process of facilitating interactions between an entertainment game and a gambling game in accordance with embodiments of the invention.

A timing diagram that illustrates a process of facilitating interactions between an entertainment game and a gambling game in accordance with embodiments of the invention is illustrated in FIG. 4. The process includes a player performing a player action using a user interface. An ESE 406 can signal (408) a GWE 404 of the player action. The GWE 404 can signal (410) the ESE 406 as to the amount of EE that will be consumed by the player action in return. The signal can configure a function that controls EE consumption, decay or addition for the ESE. The ESE 406 can, based upon the function, consume an amount of EE designated by the GWE 404 to couple to the activity. Upon detection that the player action is a gameplay gambling event, the GWE 404 can signal an RWE 402 as to the wager terms associated with the gameplay gambling event triggers (412) a wager. The RWE 402 can consume RWC in executing the wager. The RWE 402 can return RWC as a payout from the wager. The RWE 402 can inform (414) the GWE 404 as to the payout from the wager. The GWE 404 can signal (416) the ESE 406 to ascribe a payout of EE based upon the wager. The ESE 406 can reconcile and combine the payout of EE with the EE already ascribed to the player in the entertainment game. The ESE 406 can signal (408) the GWE 404 as to its updated status based upon reconciling the payout of EE, and the GWE 404 can signal the ESE 406 of a payout of GWC in response (420) to the status update.

In some embodiments, the gambling wager may be triggered by a player's use of various elements within the entertainment game. These elements include, but are not limited to, enabling elements (EE) which are elements that enable a player's play of the entertainment game and whose consumption by the player while playing the entertainment game can trigger a wager in a gambling game. Another example of an element is a reserve enabling element (REE), which is an element that converts into one or more enabling elements upon occurrence of a release event in a difference engine hybrid game gameplay. Other types of elements include actionable elements (AE) which are elements that are acted upon to trigger a wager in the gambling game and cannot be restorable during normal play of the entertainment game. In progressing through entertainment game gameplay, elements can be utilized by a player during interactions with a controlled entity (CE) which is a character, entity, inanimate object, device or other object under control of a player. Also, entertainment game gameplay progress can be dependent upon: a required object (RO) which is a specific object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RWC and elements are discussed above, any gameplay resource can be utilized to advance difference engine hybrid game gameplay as appropriate to the specification of a specific application in accordance with embodiments of the invention.

In some embodiments, the consumption of the element may occur in the ESE without intermediation by the GWE.

In other embodiments, the element is not consumed during entertainment game play but may be used to trigger a wager repeatedly.

In certain embodiments, the sequence of events in the timing diagram of FIG. 4 can be reflected in a first person shooter themed entertainment game. For example, a player can select a machine gun to use in an entertainment game and fires a burst at an opponent. The ESE can signal (408) the GWE of the player action, such as the player's choice of weapon, that a burst of fire was fired, and the outcome of whether the player hit the opponent with the burst of fire. The GWE can process the information concerning the machine gun burst, and signal (410) the ESE to consume 3 bullets (EE) with each pull of the trigger. The entertainment game then will consume 3 bullets (EE) based upon the trigger being pulled. The GWE can also signal (412) the RWE that 3 credits of RWC are to be wagered to match the 3 bullets (EE) consumed, on a particular pay table (Table Ln-RC) as a function how much damage the player inflicted on his/her opponent. The RWE can consume the 3 credits for the wager and execute the specified wager. In executing the wager, the RWE can determine that the player hits a jackpot of 6 credits, and return the 6 credits of RWC to the credit meter. The RWE can also inform (414) the GWE that 3 credits of RWC net were won as a payout from the wager. The GWE can signal (416) the ESE to add 3 bullets (EE) to the player's ammunition clip based upon the gambling game payout. The ESE can then add 3 bullets (EE) to the player's ammunition clip in the entertainment game. This can take place by directly adding them to the clip, or can happen in the context of the entertainment game, such as the player finding extra ammunition on the ground or in an old abandoned ammunition dump. The GWE can receive (418) an update from the ESE as to the total amount of EE associated with the player. The GWE can log the new player score (GWC) in the game (as a function of the successful hit on the opponent) based on the update, and signal (420) the ESE to add 2 extra points of GWC to the player's score.

Figure 5A:
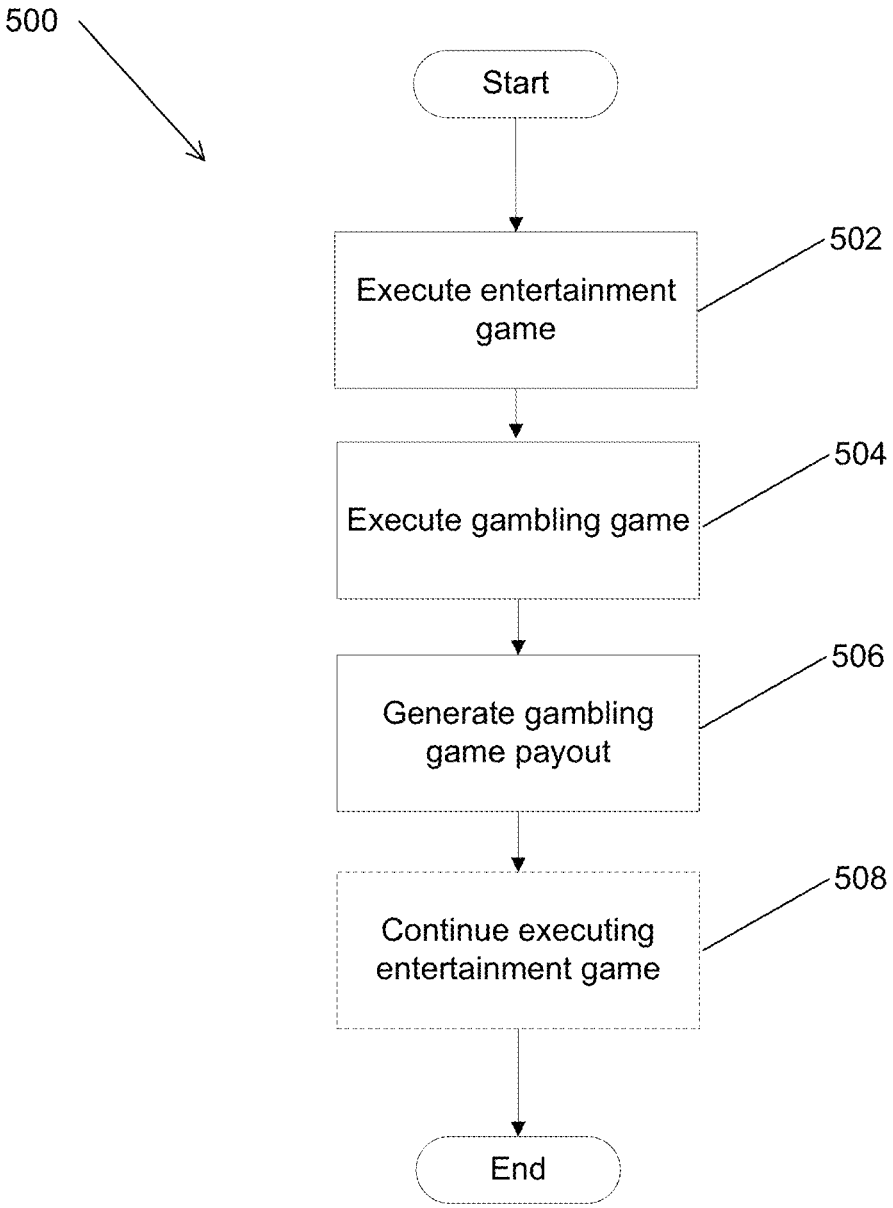
FIG. 5A illustrates a flow chart of a process for difference engine hybrid game gameplay utilizing resources in accordance with embodiments of the invention.

A process for utilizing resources within a difference engine hybrid game during gameplay in accordance with embodiments of the invention is illustrated in FIG. 5A. The process 500 includes executing (502) an entertainment game, which in turn can trigger the execution (504) of a gambling game. The gambling game can generate (506) a payout of RWCs due to a wager made within the gambling game. Optionally, the entertainment game can continue (508) to execute during and/or after the execution of the gambling game and/or the payout from wagers made during the gambling game.

Figure 5B:
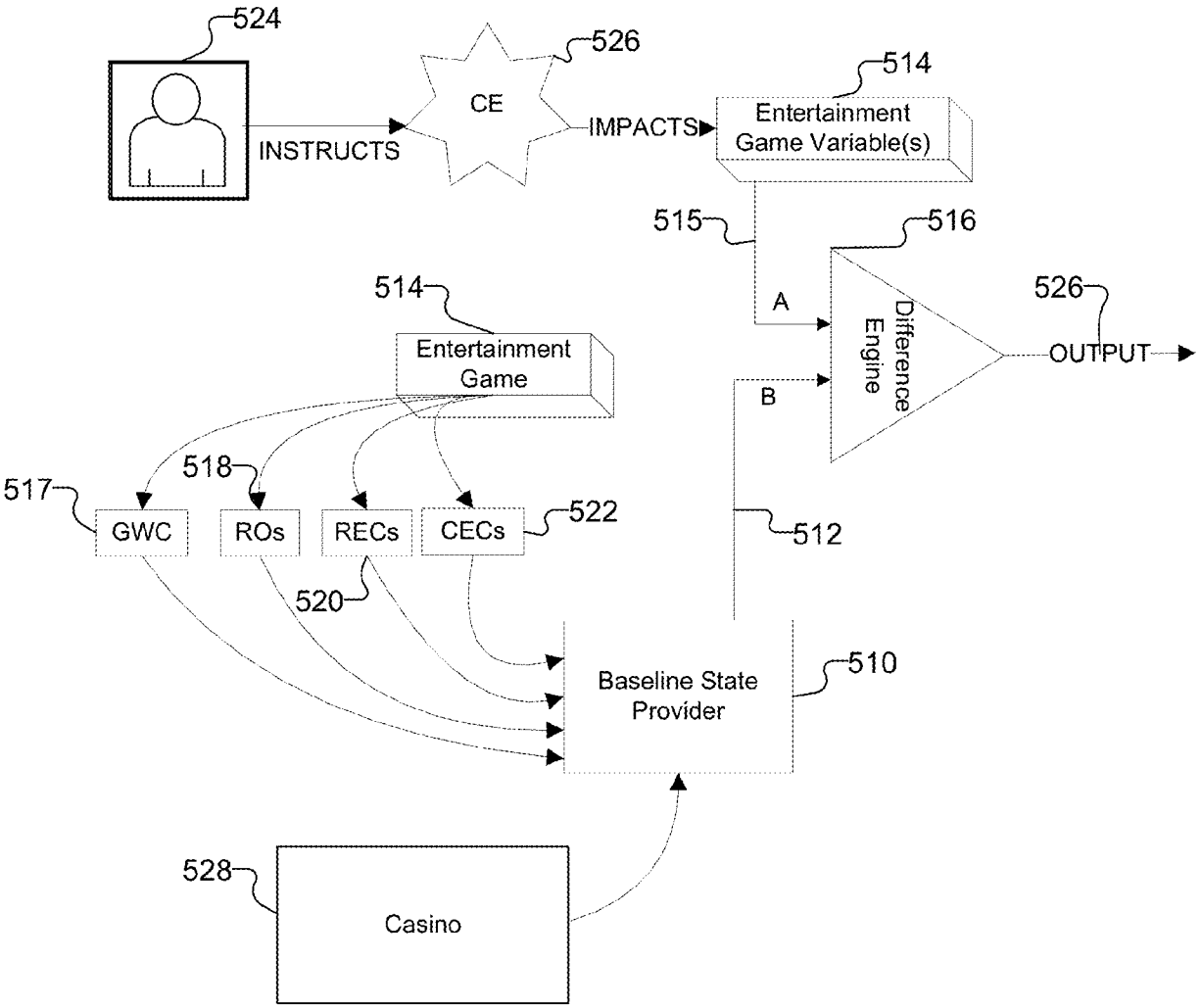
FIG. 5B illustrates a conceptual diagram that illustrates utilization of resources through a controlled entity in the process illustrated in FIG. 5A in accordance with an embodiment of the invention.

A conceptual diagram that illustrates utilization of resources through a controlled entity (CE) in the process illustrated in FIG. 5A in accordance with an embodiment of the invention is illustrated in FIG. 5B. In operation, a player 524 instructs a controlled entity 526 to take an action within an entertainment game. The actions of the controlled entity within the entertainment game cause changes or impacts one or more entertainment game variables 514 within the entertainment game. These entertainment game variables then serve as an input A 515 into a difference engine 516.

A baseline state provider 510 calculates input B 512 (in the case of a single variable difference engine) or a set (B1, B2, B3, etc.) in the multi-variable case as a function of the current state of game play of an entertainment game 514. B (or its set analog) represents a baseline against which player performance is to be compared for the purposes of affecting a difference engine hybrid game's RWE resident pay tables. Examples of the types of variables that can be considered as part of this process include GWC 517, a character's skill rating, the progress towards a goal at a given point in game time, the goal differential within an ESE-resident video hockey game, one or more required objects (ROs) 518, one or more required environmental conditions 520, one or more controlled entity characteristics (CEC) 522, etc.

As an output 526 of the difference engine will be used to determine a paytable within a gambling game, a casino 528 or other difference engine hybrid game operator also provides an input to the baseline state provider.

Figure 5C:
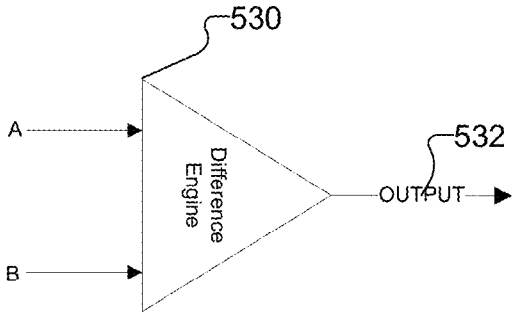
FIG. 5C is a conceptual diagram that illustrates data flow through a difference engine in accordance with an embodiment of the invention.

FIG. 5C is a conceptual diagram that illustrates data flow through a difference engine in accordance with an embodiment of the invention. A difference engine 530 creates an output 532 as a function of the difference between the current game state A and a baseline performance level B identified by a baseline state provider in the context of the current state of an entertainment game.

In one embodiment of a difference engine in accordance with an embodiment of the invention, the output is always between zero and one, but the output can be any value pursuant to the algorithm deployed within the difference engine. For example, the algorithm could compare the input A to a normal distribution of player performance at the current juncture in the entertainment game, such that B represents not a singular value, but a representation of the historical performance of one or a multitude of players at the current juncture in the entertainment game. The difference engine, in this embodiment, would evaluate A against that distribution and output a value that reflected where A would be placed in that distribution (e.g. if at the mean the output might be 0.5, at the far low range of the distribution, 0, at the first standard deviation to the right of the mean, 0.67, and that the top 1% of the distribution the output might be 1.

In another embodiment, in a difference engine hybrid game composed of a first person shooter style entertainment game, a player's actual GWC accumulated at a time of firing a bullet is used as an input A. Input B is a reference amount of GWC as a function of entertainment game configuration, player skill, time in play, challenges experienced by player. The difference engine 530 determines the difference between the two values and generates the output 532 proportional to that difference.

In another embodiment, a difference engine hybrid game implementation of a first person shooter requires players to move through a computer generated environment "killing" enemy combatants using a variety of weapons. In this game bullets are EE, and the firing of each bullet initiates a gambling game, the result of which may augment EE and RC as previously described. At the point in time at which each bullet is fired, the pay table is adjusted from a reference level as a function of the player's GWC in the entertainment game relative to a reference value. If the player's GWC is below the reference value, the baseline pay table for the game is used. If the player's GWC is greater than the reference value, a pay table with a higher probability of returning a payout is used. The following table describes the output of f3, i.e. the pay table put into play as a function of (A-B).

TABLE 1

| (A-B) | Output of F3 | Odds |
|---|---|---|
| A < B | Pay Table 1 | Reference Odds |
| A = B | Pay Table 2 | Improved Odds |
| A > B | Pay Table 3 | Even better Odds |
| A >> B | Pay Table 4 | Best Odds |

Figure 5D:
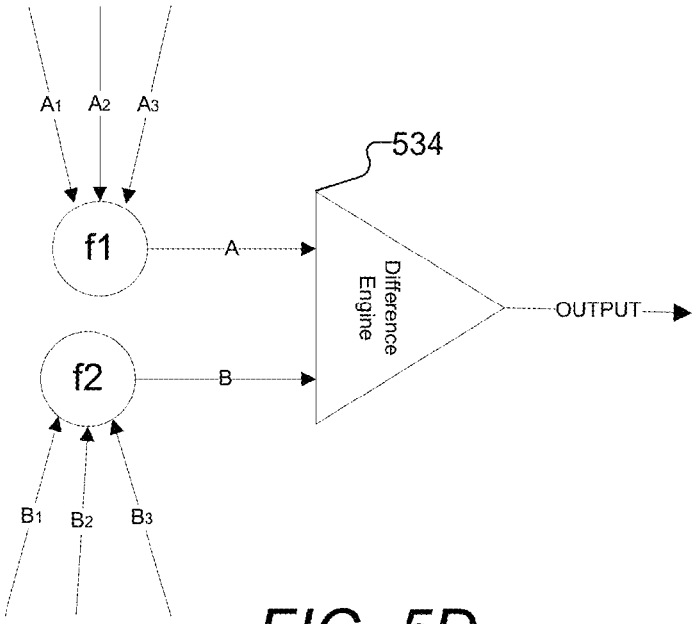
FIGS. 5D and 5E are conceptual diagrams that illustrate data flow through a difference engine having a plurality of inputs in accordance with various embodiments of the invention.
Figure 5E:
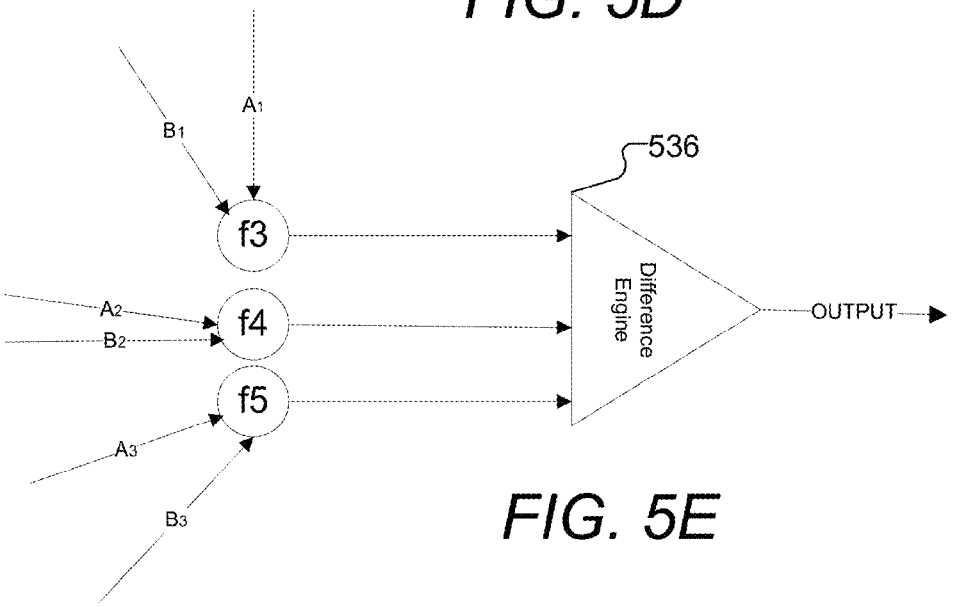

FIGS. 5D and 5E are conceptual diagrams that illustrate data flow through a difference engine having a plurality of inputs in accordance with various embodiments of the invention. In FIGS. 5D and 5E, inputs A and B are sets of inputs, (A1, A2, A3, . . . ) for A and (B1, B2, B3, . . . ) for B. A difference engine 534 or 536 operates on these sets according to a pre-established processes set by a casino. A set of inputs, such as (A1, A2, A3, . . . ), can be reduced to a single value by a functions, such as f1, and then compared to a single value distillation, using function f2, of the inputs (B1, B2, B3, . . . ) as seen FIG. 5D. Alternatively, the difference engine can operate on the individual A-B sets and then distills the results of this operation to a single value, namely the OUTPUT as seen in FIG. 5E. As shown in 5E, function f3 operates on the pair of A1 and B1, function f4 operates on inputs A2 and B2, and function f5 operates on the pair of inputs A3 and B3.

Figure 6:
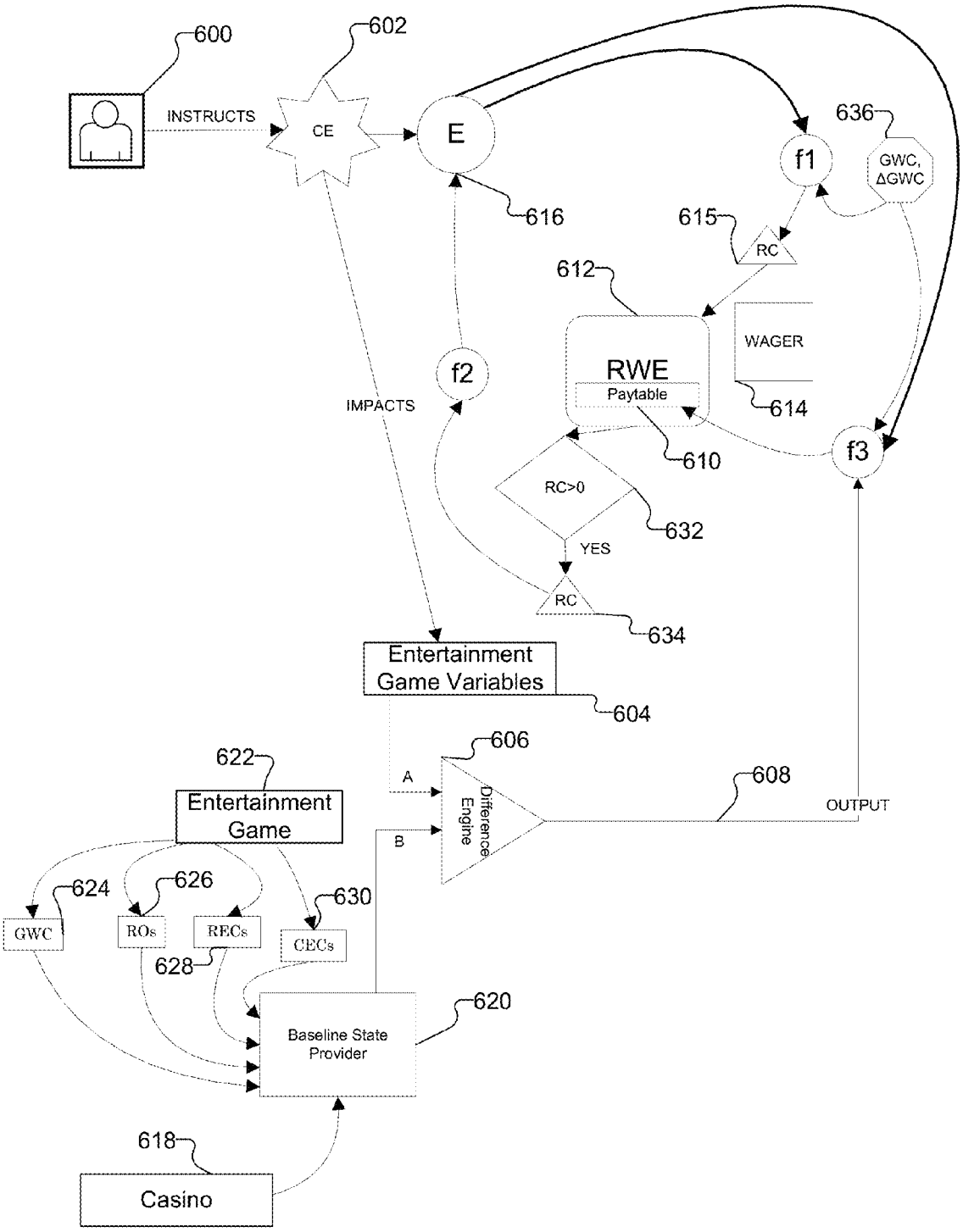
FIG. 6 is a process flow diagram illustrating credit flow and management in a difference engine hybrid game that includes a difference engine in accordance with an embodiment of the invention.

FIG. 6 is a process flow diagram illustrating credit flow and management in a difference engine hybrid game that includes a difference engine in accordance with an embodiment of the invention. In FIG. 6, a player 600 commences interaction with an entertainment game through an agent, a controlled entity 602 or direct action. Changes A in entertainment game variables 604 are compared to a baseline state B through a difference engine 606. An output 608 may be used within the difference engine hybrid game system in a variety of ways. In some embodiments, the difference engine output is included in a function f3 as an element determining the odds table 610 in the RWE 612. In many embodiments, the output 608 is included in a function f1 as an element determining an amount of a wager 614. Function f1 regularly obtains or receives a state of one or more enabling elements 614 via sampling, polling or another method. In addition, f3 regularly obtains or receives the state of the one or more enabling elements 616 via sampling, polling or another method.

In operation, the player 600 interacts with the difference engine hybrid game system via instruction of a CE 602 that performs an action within the difference engine hybrid game. In various embodiments, the player may interact with the entertainment game directly or through an agent. The actions of the controlled entity within the entertainment game cause changes or impacts one or more entertainment game variables 604 within the entertainment game. These entertainment game variables then serve as an input A into a difference engine 606.

A baseline state provider 620 calculates input B (in the case of a single variable difference engine) or a set (B1, B2, B3, etc.) in the multi-variable case as a function of the current state of game play of the entertainment game 622. B (or its set analog) represents a baseline against which player performance is to be compared for the purposes of affecting a difference engine hybrid game's RWE resident pay tables. Examples of the types of variables that can be considered as part of this process include GWC 624, a character's skill rating, the progress towards a goal at a given point in game time, the goal differential within an ESE-resident video hockey game, one or more required objects (ROs) 626, one or more required environmental conditions 628, one or more controlled entity characteristics (CEC) 630, etc.

As an output 608 of the difference engine will be used to determine a paytable 610 within a gambling game executed by RWE 612, a casino 618 or other difference engine hybrid game operator also provides an input to the baseline state provider.

As the player 600 plays the entertainment game portion of the difference engine hybrid game, elements 616 within the entertainment game are used to perform actions within the entertainment game. Player action resulting in the use of these elements is provided as input to function f1 that makes a determination of whether or not the use of elements is associated with a wager in a gambling game. If so a wager 614 of real world credits is triggered in the gambling game as executed by the RWE 612. The outcome of the wager is determined through the use of an output of an RNG (not shown) and a paytable 610 as selected by the output of the difference engine 606.

In some embodiments, if the wager outcome is positive (632) resulting in an addition of real world credit 634 to the player's account, function f2 affects the entertainment game by adding to the entertainment game one or more elements to be acted upon by the player.

In many embodiments, the actions of the player in playing the entertainment game result in the awarding of game world credit to the player. An amount or rate of accumulation of the game world credit may be used as in input to function f1, thus affecting the triggering of the wager 614, or as input to function f3, thus affecting the selection of the paytable 610.

Figure 7:
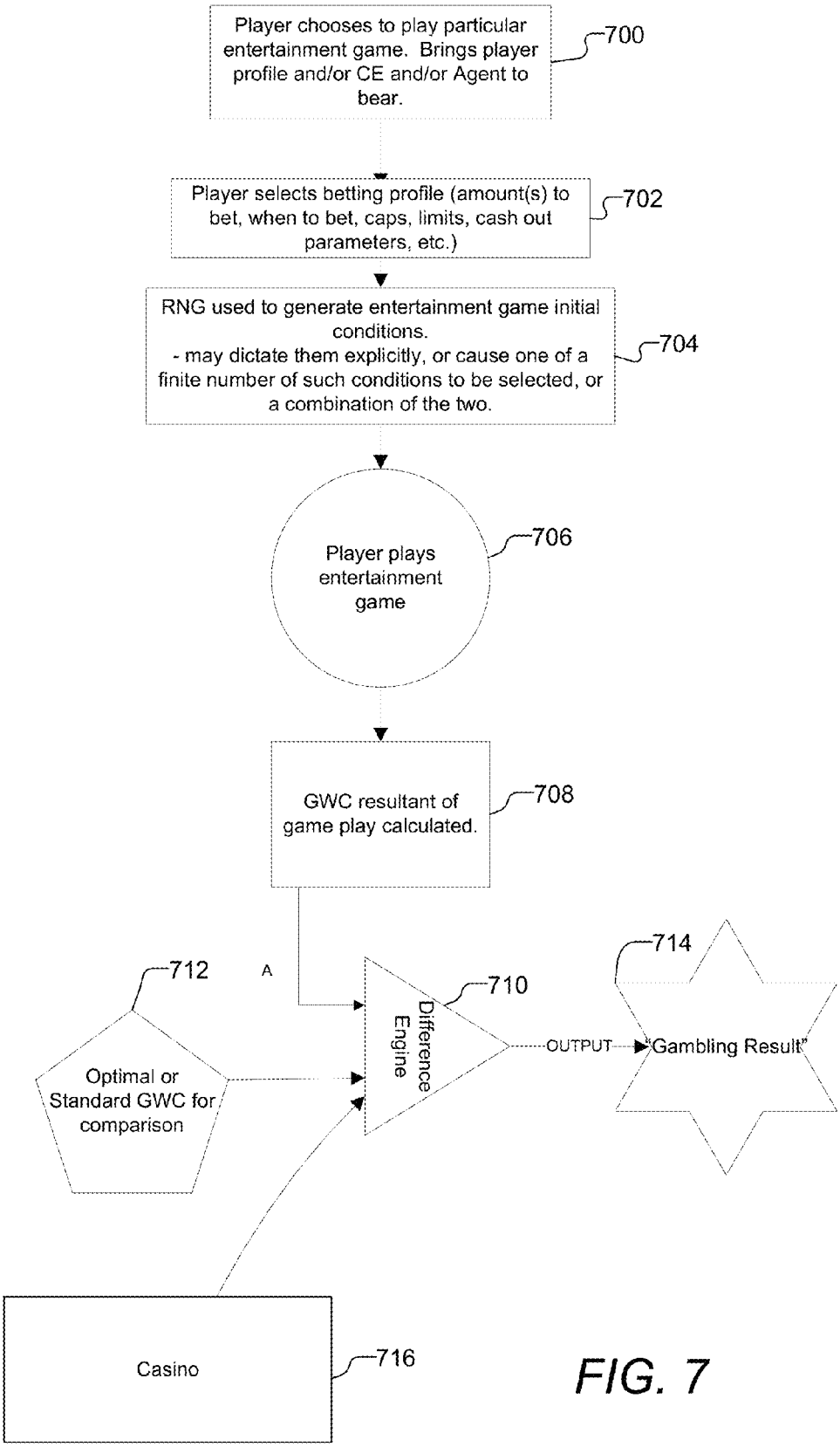
FIG. 7 is a process flow diagram illustrating operation of a difference engine hybrid game in accordance with an embodiment of the invention.

FIG. 7 is a process flow diagram illustrating operation of a difference engine hybrid game in accordance with an embodiment of the invention. In FIG. 7, a difference engine hybrid game with a difference engine is a game in which the randomness within the game comes in via the initial state of the game and/or changes to the game state introduced (through in part a random process) throughout the game. The player's (or CE or agent) performance in the context of this random environment, when compared to a pre-specified, baseline, state dictates payouts of the gambling game. In this way the gambling game and skill elements are highly integrated.

The process begins when a player chooses (700) to play particular entertainment game. The player brings a player profile and/or a controlled entity and/or an agent to bear in an entertainment game portion of a difference engine hybrid game. The player selects (702) a betting profile (amount(s) to bet, when to bet, caps, limits, cash out parameters, etc. The difference engine hybrid game uses an RNG used to generate (704) entertainment game initial conditions that may dictate them explicitly, or cause one of a finite number of such conditions to be selected, or a combination of the two. The player plays (706) the entertainment game portion of the difference engine hybrid game and a GWC resultant of the game play is calculated (708).

In various embodiments, the player can have a wager triggered at end of rounds of a boxing game, as a function of each trigger pull, as a function of game end, as a function of any sort of in-game trackable trigger at which junction an assessment of performance can be made against an ideal or standard.

The player plays the game to a logical break point, i.e. an end point or the end of a round or level. Diagrammatically, this break point occurs at 706. This process, however, can take place only after game completion AND/OR continually throughout the game. At 708, GWC is the measure used to drive the difference engine. In various embodiments, other entertainment game related measures and/or a combination of the above are used as inputs to the difference engine.

At 710, the difference engine produces the output necessary for the difference engine hybrid game. The difference engine need not simply calculate a difference, but can apply the difference between actual and optimal results 712 to any number of algorithms or statistical analyses to determine a wager result or payout 714. In many embodiments, a difference engine hybrid game operator, such as a casino 714 parameterizes these calculations. Accordingly, regulators can inspect the contents of the difference engine as well. In some embodiments, the difference engine includes its own RNG that further randomizes the output.

In various embodiments, an optimal GWC for an entertainment game is determined given initial conditions and possibly including assessment of player profile and/or player skill. In other embodiments. In some embodiments, a standard of player performance is determined In lieu of an optimal performance.

Figure 8:
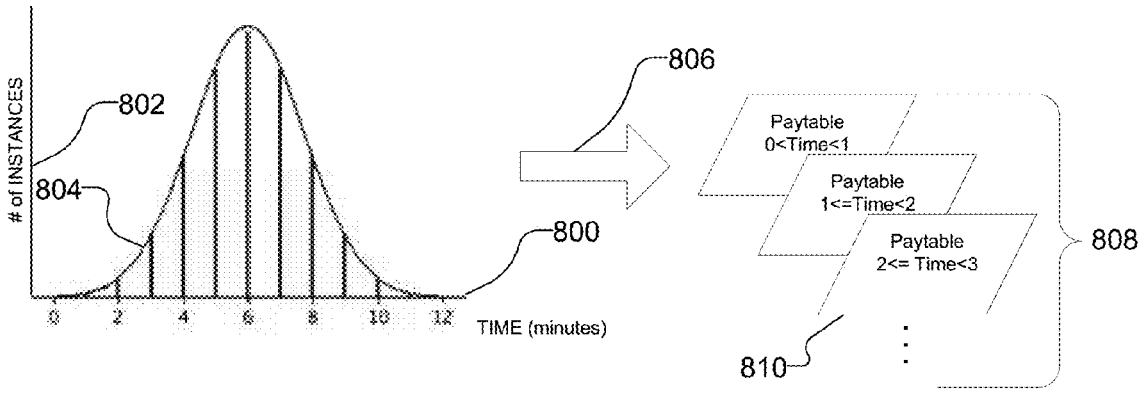
FIG. 8 is an illustration of how a standard of player performance may be used to determine a paytable in accordance with an embodiment of the invention.

FIG. 8 is an illustration of how a standard of player performance may be used to determine a paytable in accordance with an embodiment of the invention. In such an embodiment, one or more entertainment game variables associated with an individual player, or one or more player entertainment game play metrics of an individual player, are mapped to a specific paytable of a gambling game based on a distribution of the one or more entertainment game variables or the one or more player entertainment game play metrics for a population of players. In the illustrated embodiment, a difference engine hybrid game is composed of an entertainment game that is a word game wherein letters are placed on a board in order to spell out words, such as Scrabble®, and a gambling game having a simple paytable and RNG. In such a game, a player entertainment game play metric includes, but is not limited to, the time it takes for a player to make a placement of one or more letters when making a word. As illustrated in FIG. 8, a distribution of the number of instances of players taking a specific time to make a placement may be plotted on a graph where an axis 800 represents the time it takes to make the placement and another axis 802 represents number of instances of a player taking a particular time to make a placement. As illustrated, such a distribution may be a normal Gaussian distribution although other distributions may more accurately describe such data. The distribution of placement times may be divided into bands, such as band 804 and these bands may then be mapped 806 to a separate one of a plurality of pay tables, 808. For example, band 804, representing a player taking between 2 or more minutes but less than 3 minutes to make a placement will have a paytable 810 determined for the player's next wager in a gambling game. In another embodiment, a specific pay table is used in the gambling game as a function of the player having taken between 4 and 5 minutes (measured from start of game) to correctly place the 6th number. A distinct pay table is associated with each one minute band from zero to 12+ minutes. The pay table associated with each band is mathematically linked to the distribution curve itself.

In another embodiment, a difference engine hybrid game implementation of Sudoku requires players to fill 81 boxes with a number 1-9, such that each row, column and 9-box square contains the numbers 1-9. In this example, the EE are the 81 numbers (1-9, each nine times) that one places on the board, as each number is placed in the 81-box grid, a gambling game is triggered. The gambling game odds are characterized as a function of a difference engine. The difference engine is parameterized as a function of the time the player took to place the number and whether the placement was correct or not. In the case where the placement is incorrect, regardless of how long it took the player, a reference pay table is used. The player's actual time to place, when the placement is correct, is compared to a distribution of historical times to place numbers for players of similar skill playing Sudoku boards of similar difficulty. In other examples, the players' skill and/or game board difficulty need not be considered. Depending upon where the player's actual time to place falls relative to this distribution (which is in this example is specific to the number being placed—i.e. there is a distribution for each of correct placements one through eighty-one).

As an example calculation in this embodiment, the difference engine calculates the difference between the number of instances in the histogram for the band where the player's actual placement fell (in this case between 4 and 5 minutes) and the mean value of the histogram. This difference is fed to a function, such as f3 of FIG. 6, where (in this example), a specific pay table is selected based upon this value, and no other input.

In another embodiment, such as a difference engine hybrid game implementation of chess, players are required to move different pieces in response to their opponent. Based on the layout of the board, there are moves that are more advantageous than other moves. The difference engine is parameterized as a function of the time the player took to place the piece and quality of the move when compared to an ideal, or set of ideal placements. In the case where the placement is not ideal, regardless of how long it took the player, a reference pay table is used. The player's actual time to move, when the placement is ideal, is compared to a distribution of historical times to move for players of similar skill playing chess opponents of similar difficulty. In other examples, the players' skill and/or opponent difficulty need not be considered. Depending upon where the player's actual time to move falls relative to this distribution (which is in this example is specific to the number being placed—i.e. there is a distribution for each of correct placements one through eighty-one).

In other embodiments, other player entertainment game play metrics or entertainment game variables may be used by a difference engine hybrid game to make a paytable determination as described herein.

Figure 9:
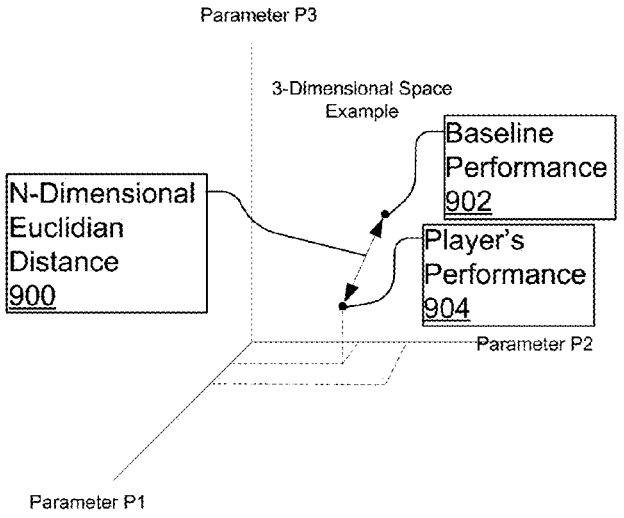
FIG. 9 is an illustration of how a Euclidean distance may be determined between a player's performance and a baseline or reference performance in a difference engine hybrid game in accordance with an embodiment of the invention.

FIG. 9 is an illustration of how a Euclidean distance 900 may be determined between a player's performance 904 and a baseline or reference performance 902 in a difference engine hybrid game in accordance with an embodiment of the invention. In such an embodiment, the difference between a player's performance and a baseline performance can be expressed as a Euclidean distance in an N-dimensional space where each dimension of the space is a parameter of the player's performance. Such a calculation may be expressed by the following pseudocode.

Pseudocode for generating Euclidian distance:

```
Sum = 0
For i = 1 to N
    B[i] = Vb[i]/Range[i]
    A[i] = Vp[i]/Range[i]
    Sum = Sum + sqr(A[i]−B[i])
End For
Output = sqrt(Sum)
```

Where:

N=number of dimensions

Range[i]=range of dimension i

Vb[i]=value of baseline performance along dimension i

B[i]=normalized value of baseline performance along dimension i

Vp[i]=value of player's performance along dimension i

A[i]=normalized value of player's performance along dimension i sqr( )=square function sqrt( )=square root function Output=single value comparing player's performance to baseline performance expressed as a Euclidian distance In one embodiment, in a difference engine hybrid game including an entertainment game that is a simulation game where a player designs and builds a farm that is then subjected to a simulation of natural and economic conditions such as drought, flood, market price fluctuations, etc., the relevant parameters might include the value of the production from the farm per season, the yield of the farm per acre, and return on investment. The range of value of production might be from $0 to $1,000,000, yield of the farm per acre might range from $0 to $1000, and the return on investment might range from 0 to 0.5. Further to the example, a baseline model of the farm might have produced a value of production of $500,000, a yield per acre of $500 and a return on investment of 0.1, whereas the player might have produced a value of production of $250,000, a yield per acre of $750 and a return on investment of 0.15. That is, although the value of production by the player was lower than the baseline, the player achieved that value of production using less land (higher yield per acre) and managed to generate a higher return on investment. In this example, the Euclidean distance is approximately 0.367.

With reference to the FIG. 6, a difference engine 606 receives input from a baseline state provider of a game state of an instance of the entertainment game and the game state of the player's instance of the entertainment game. If the difference engine is implemented using a Euclidean distance as previously proposed, the output 608 of the difference engine can be shown to have an output having a lower bound of 0 and an upper bound of the square root of N were N is the number of dimensions of the Euclidean space.

In some embodiments, the output of the difference engine is then input as the selector value to a multiplexer that selects between a plurality of pay tables. The multiplexer is constructed to output at least one of the paytables as a default value, otherwise the multiplexer outputs a paytable as selected by the output of the difference engine. The operation of such a multiplexer can be described in accordance with the following pseudocode:

Pseudocode for multiplexer:

```
output_paytable = paytable[1]
receive difference from difference engine
while i = number_of_paytables to 2
    if range[i] > distance >= range[i-1], then output_paytable =
paytable[i]
end while
```

Where:

output_paytable is the paytable selected from plurality of paytables paytable[ ] is an array holding the plurality of paytables range[ ] is an array holding ranges of values for the distance, the ranges in units of the difference measure difference is the measure of the difference between the player's performance and the baseline performance The paytable is then used in conjunction with the output of a RNG/PRNG and a wager amount to determine the gambling result.

Although various components of difference engine hybrid games are discussed above, difference engine hybrid games can be configured with any component as appropriate to the specification of a specific application in accordance with embodiments of the invention. In certain embodiments, components of a difference engine hybrid game, such as a GWE, RWE, ESE can be configured in different ways for a specific difference engine hybrid game gameplay application. Network connected difference engine hybrid games are discussed below.

Network Connected Difference Engine Hybrid Games

Difference engine hybrid games in accordance with many embodiments of the invention can operate locally while being network connected to draw services from remote locations or to communicate with other difference engine hybrid games. In many embodiments, operations associated with a difference engine hybrid game utilizing a difference engine module can be performed across multiple devices. These multiple devices can be implemented using a single server or a plurality of servers such that a difference engine hybrid game is executed as a system in a virtualized space, such as (but not limited to) where the RWE and GWE are large scale centralized servers in the cloud coupled to a plurality of widely distributed ESE controllers or clients via the Internet.

In many embodiments, an RWE server can perform certain functionalities of a RWE of a difference engine hybrid game. In certain embodiments, a RWE server includes a centralized odds engine which can generate random outcomes (such as but not limited to win/loss outcomes) for a gambling game. The RWE server can perform a number of simultaneous or pseudo-simultaneous runs in order to generate random outcomes for a variety of odds percentages that one or more networked difference engine hybrid games can use. In certain embodiments, an RWE of a difference engine hybrid game can send information to a RWE server including (but not limited to) Table Ln-RWC tables, maximum speed of play for a gambling game, gambling game monetary denominations or any promotional RWC provided by the operator of the difference engine hybrid game. In particular embodiments, a RWE server can send information to a RWE of a difference engine hybrid game including (but not limited to) RWC used in the gambling game, player profile information or play activity and a profile associated with a player.

In several embodiments, a GWE server can perform the functionality of the GWE across various difference engine hybrid games. These functionalities can include (but are not limited to) providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GWE server. A patron management server can manage information related to a player profile, including (but not limited to) data concerning controlled entities (such as characters used by a player in entertainment game gameplay), game scores, elements, RWC and GWC associated with particular players and managing tournament reservations. Although a patron management server is discussed separate from a GWE server, in certain embodiments a GWE server also performs the processes of a patron management server. In certain embodiments, a GWE of a difference engine hybrid game can send information to a patron management server including (but not limited to) GWC and RWC used in a game, player profile information, play activity and profile information for players and synchronization information between a gambling game and an entertainment game or other aspects of a difference engine hybrid game. In particular embodiments, a patron management server can send information to a GWE of a difference engine hybrid game including (but not limited to) entertainment game title and type, tournament information, Table Ln-GWC tables, special offers, character or profile setup and synchronization information between a gambling game and an entertainment game or other aspects of a difference engine hybrid game.

In numerous embodiments, an ESE server provides a host for managing head to head play, operating on the network of ESEs which are connected to the ESE server by providing an environment where players can compete directly with one another and interact with other players. Although an ESE server is discussed separate from a GWE server, in certain embodiments a GWE server also performs the processes of an ESE server.

In several embodiments, an difference engine server can be connected with a difference engine hybrid game and can implement a difference engine module to coordinate the activities of a difference engine hybrid game. A difference engine module can execute as part of an difference engine server to allocate a gambling game agent wager payout resulting from at least one agent player action generated from an agent player profile configured by a player of the difference engine hybrid game.

Servers connected via a network to implement difference engine hybrid games in accordance with many embodiments of the invention can communicate with each other to provide services utilized within a difference engine hybrid game. In several embodiments a RWE server can communicate with a GWE server. A RWE server can communicate with a GWE server to communicate any type of information as appropriate for a specific application, including (but not limited to): information used to configure the various simultaneous or pseudo simultaneous odds engines executing in parallel within the RWE to accomplish difference engine hybrid game system functionalities, information used to determine metrics of RWE performance such as random executions run and outcomes for tracking system performance, information used to perform audits, provide operator reports, and information used to request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server during a difference engine hybrid game tournament. Typically a GWE (such as a GWE that runs within a difference engine hybrid game or on a GWE server) is not aware of the relationship of itself to the rest of a tournament since in a typical configuration the actual tournament play is managed by the ESE server. Therefore, management of a difference engine hybrid game tournament can include (but is not limited to) tasks such as: conducting tournaments according to system programming that can be coordinated by an operator of the difference engine hybrid game; allowing entry of a particular player into a tournament; communicating the number of players in a tournament and the status of the tournament (such as but not limited to the amount of surviving players, their status within the game, time remaining on the tournament); communicating the performance of its players within the tournament; communicating the scores of the various members in the tournament; and providing a synchronizing link to connect the GWEs in a tournament with their respective ESE's.

In several embodiments a GWE server can communicate with a patron management server. A GWE server can communicate with a patron management server to communicate any type of information as appropriate for a specific application, including (but not limited to) information for configuring tournaments according to system programming conducted by an operator of a difference engine hybrid game, information for exchange of data used to link a player's player profile to their ability to participate in various forms of sponsored gameplay (such as but not limited to the difficulty of play set by the GWE server or the GWE), information for determining a player's ability to participate in a tournament as a function of a player's characteristics (such as but not limited to a player's gaming prowess or other metrics used for tournament screening), information for configuring GWE and ESE performance to suit preferences of a player on a particular difference engine hybrid game, information for determining a player's play and gambling performance for the purposes of marketing intelligence, and information for logging secondary drawing awards, tournament prizes, RWC and GWC into the player profile.

In many embodiments, the actual location of where various algorithms and processes are executed can be located either in the game contained devices (RWE, GWE, ESE), on the servers (RWE server, GWE server, or ESE server), or a combination of both game contained devices and servers. In particular embodiments, certain functions of a RWE server, GWE server, patron management server or ESE server can operate on the local RWE, GWE or ESE contained with a difference engine hybrid game locally. In certain embodiments, a server is a server system including a plurality of servers, where software can be run on one or more physical devices. Similarly, in particular embodiments, multiple servers can be combined on a single physical device.

Figure 10:
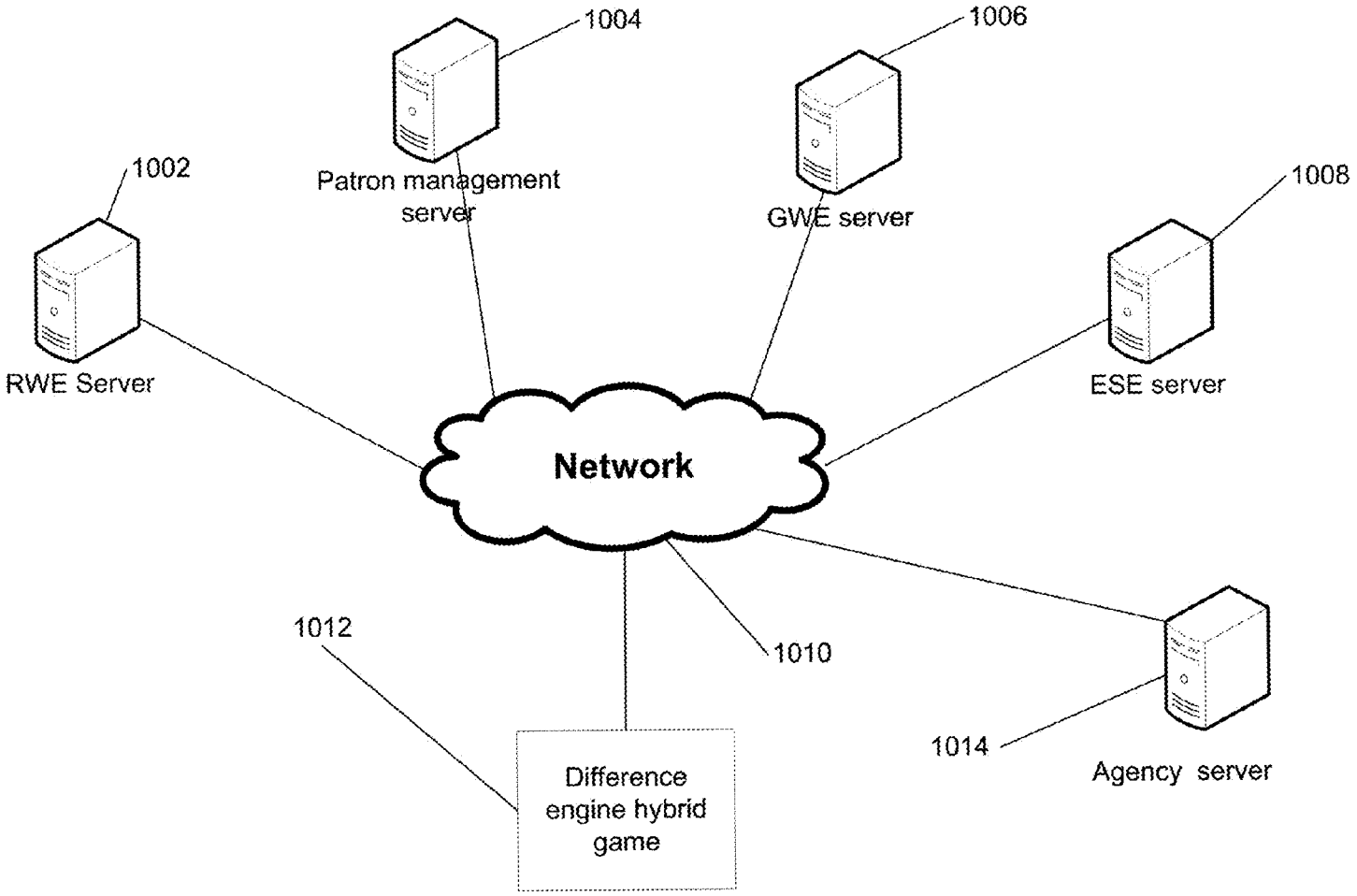
FIG. 10 is a system diagram of a networked difference engine hybrid game in accordance with an embodiment of the invention.

Difference engine hybrid games in accordance with many embodiments of the invention can be networked with remote servers in various configurations. A networked difference engine hybrid game in accordance with an embodiment of the invention is illustrated in FIG. 10. The networked difference engine hybrid game 1012 is connected with a RWE server 1002, patron management server 1004, GWE server 1006, ESE server 1008 and an difference engine server 1014 over a network 1010, such as (but not limited to) the Internet. Servers networked with a networked difference engine hybrid game 1012 can also communicate with each of the components of a networked difference engine hybrid game and amongst the other servers in communication with the networked difference engine hybrid game 1012.

Figure 11:
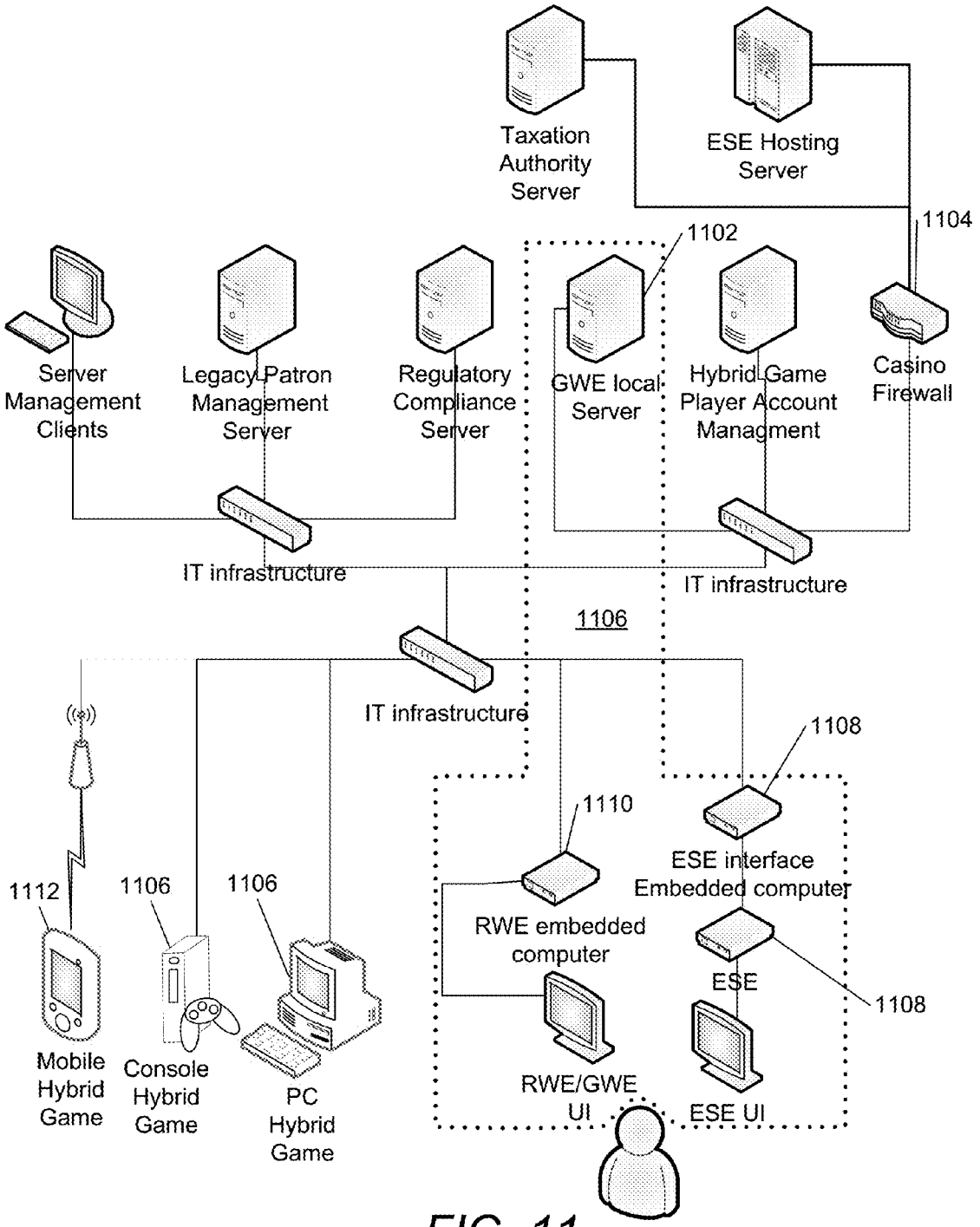
FIG. 11 is a system diagram of an implementation of a network distributed difference engine hybrid game with a GWE local server in accordance with an embodiment of the invention.

A system diagram that illustrates an implementation of a network distributed difference engine hybrid game with a GWE local server in accordance with an embodiment of the invention is illustrated in FIG. 11. The system includes several difference engine hybrid games 1106 sharing services from the same GWE local server 1102 over a network. The several difference engine hybrid games can be implemented on any device, including laptops, desktop computers, mobile phones, tablets or a wireless personal digital assistant 1112 (PDA) over a wireless connection. A single difference engine hybrid game 1106 with a RWE 1110, ESE 1108 and GWE 1102 is enclosed within a dotted line. A number of other peripheral systems, such as player management, casino management, regulatory, and hosting servers can also interface with the difference engine hybrid games over a network within an operator's firewall 1104. Also, other servers can reside outside the bounds of a network within an operator's firewall 1104 to provide additional services for network connected difference engine hybrid games.

Figure 12:
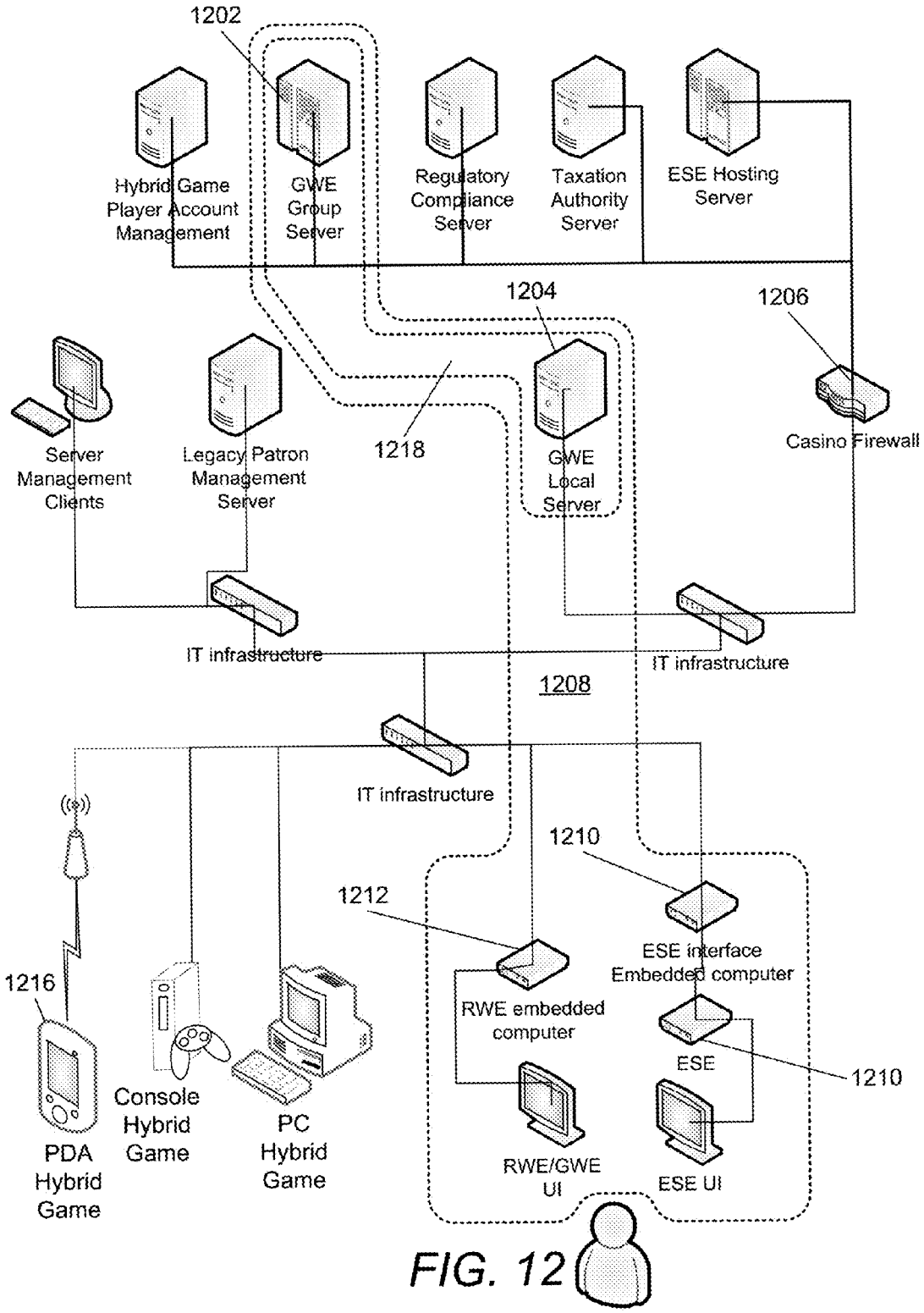
FIG. 12 is a system diagram that illustrates an implementation of a network distributed difference engine hybrid game with a GWE local server and a GWE group server in accordance with an embodiment of the invention.

A system diagram that illustrates an implementation of a network distributed difference engine hybrid game with a GWE local server and a GWE group server in accordance with an embodiment of the invention is illustrated in FIG. 12. This system includes a difference engine hybrid game with a RWE 1212, ESE 1210 and GWE local server 1204 enclosed within a dotted line but where a single difference engine hybrid game can call upon services from servers within an operator's firewall 1206 (such as but not limited to a GWE local server) as well as beyond an operator's firewall 1206 (such but not limited to a GWE group server 1202). The GWE group server 1202 can coordinate multiple difference engine hybrid games from across a network that spans beyond an operator's firewall 1206. A GWE server system 1218 can include multiple GWE servers, such as but not limited to a GWE local server 1204 and a GWE group server 1202. Multiple network connected difference engine hybrid games can implemented using various computing devices (such as but not limited to laptops, desktop computers, mobile phones, tablets or a wireless PDA 1216) and be connected to various servers to call upon services that enable the execution of the difference engine hybrid game.

Figure 13:
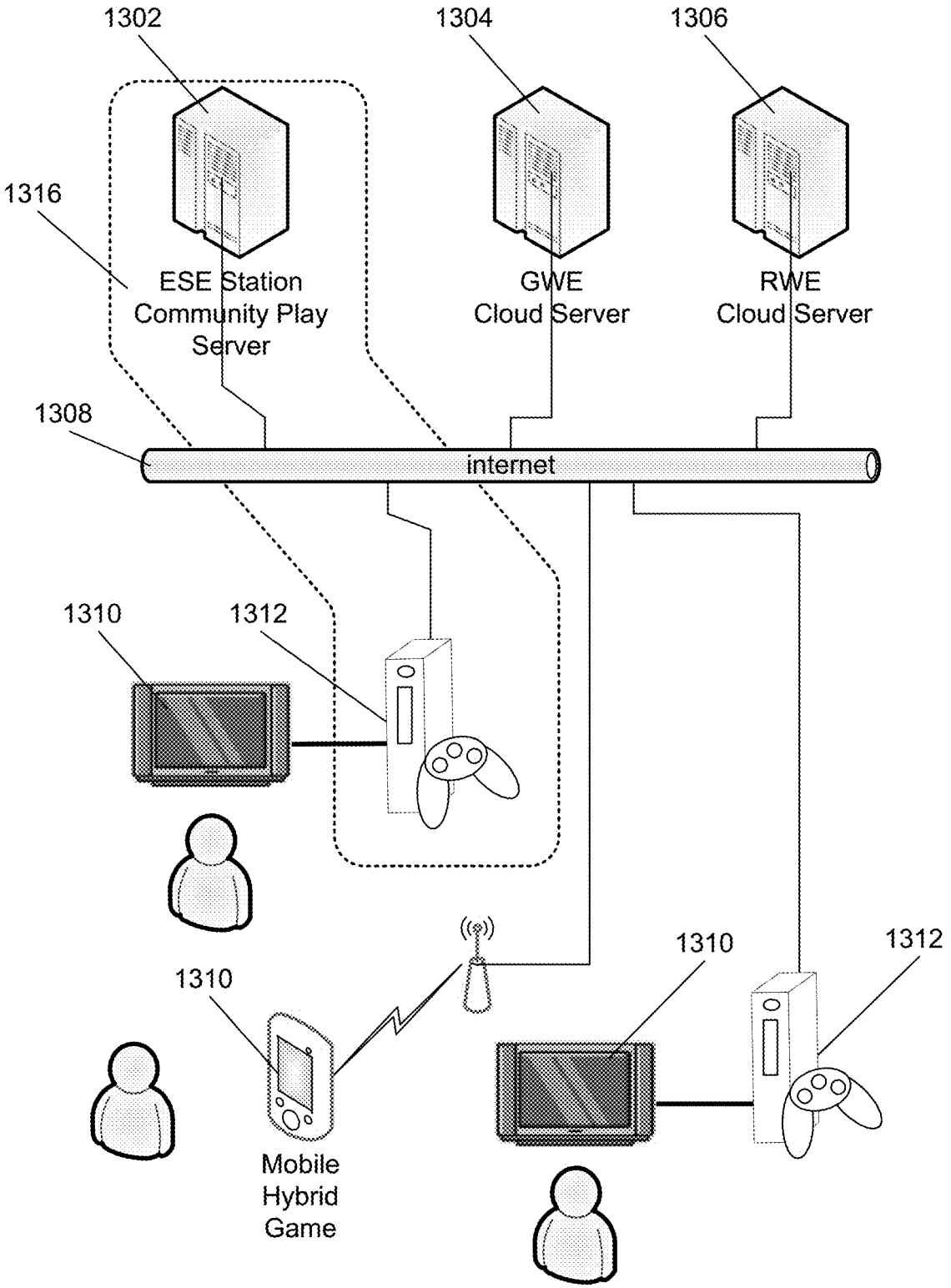
FIG. 13 is a system diagram that illustrates an implementation of network distributed difference engine hybrid games over the Internet in accordance with an embodiment of the invention.

A system diagram that illustrates an implementation of network distributed difference engine hybrid games over the Internet in accordance with an embodiment of the invention is illustrated in FIG. 13. The system includes an ESE server 1302, GWE server 1304 and RWE server 1306 that connects to a user interface 1310 (such as but not limited to a television screen, computer terminal, tablet, touchscreen or PDA) of difference engine hybrid games over the Internet 1308. Each difference engine hybrid game includes a local ESE 1312 that also interfaces with a remote ESE server 1302. Processes performed by an ESE 1316 services can be performed in multiple locations, such as but not limited to remotely on an ESE server 1302 and locally on a local ESE 1312.

Although various networked difference engine hybrid games are discussed above, difference engine hybrid games can be networked in any configuration as appropriate to the specification of a specific application in accordance with embodiments of the invention. In certain embodiments, components of a networked difference engine hybrid game, such as a GWE, RWE, ESE or servers that perform services for a GWE, RWE or ESE, can be networked in different configurations for a specific networked difference engine hybrid game gameplay application. Difference engine modules are discussed below.

Difference Engine Modules

Although various constructions of difference engine modules are discussed above, difference engine modules can be constructed to facilitate difference engine hybrid game gameplay with various gameplay themes as appropriate to the specifications of a specific application in accordance with embodiments of the invention. In certain embodiments, a difference engine module can implement any variation of a competition themed entertainment game (such as but not limited to a horse racing gameplay theme, cock fighting gameplay theme or a boxing gameplay theme) where a player configures an agent (such as but not limited to a racehorse, rooster or a boxer) to compete in a competition with other players. Processing apparatuses that can be implemented in a difference engine hybrid game are discussed below.

Processing Apparatus

Figure 14:
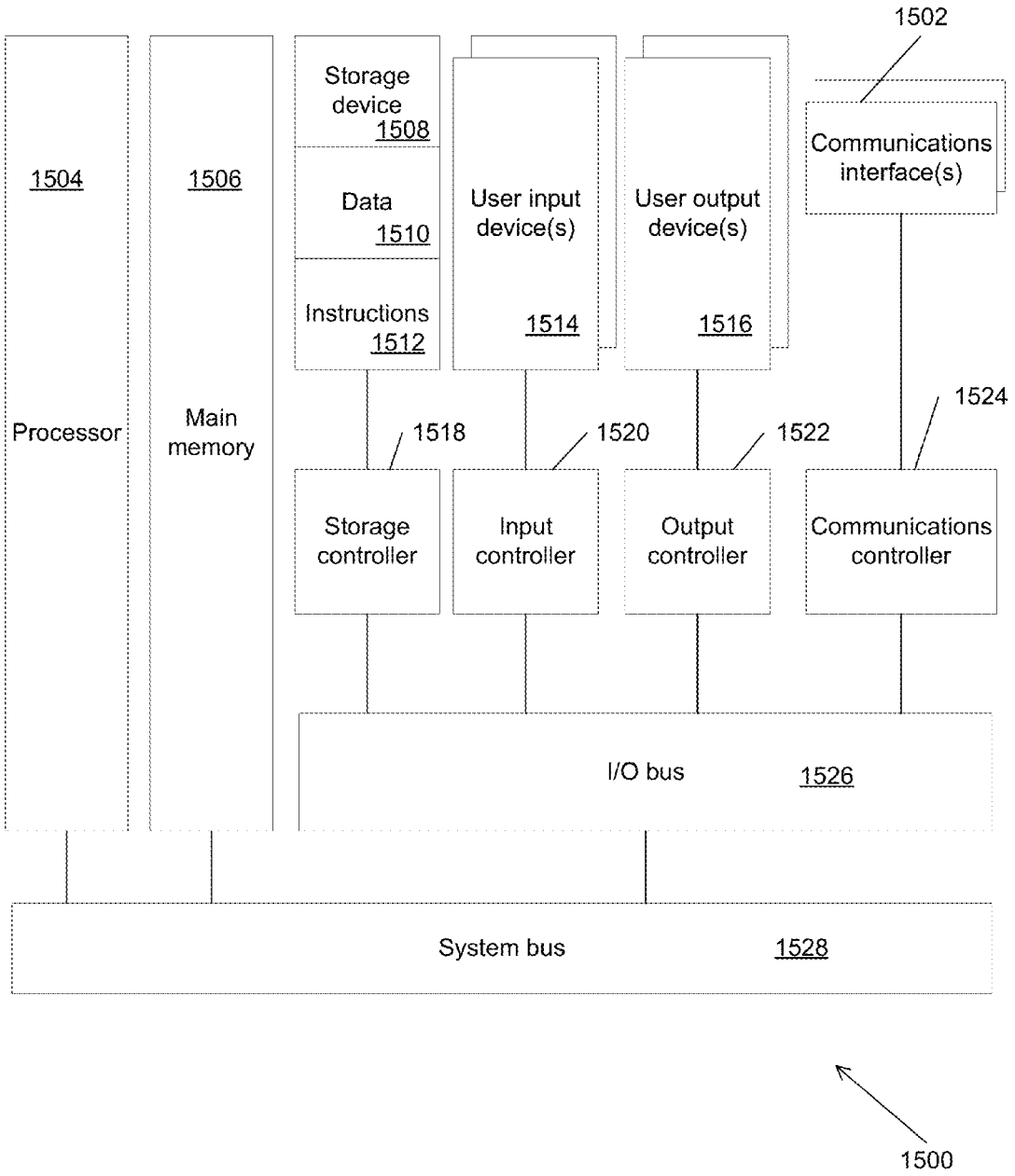
FIG. 14 illustrates a hardware architecture diagram of a processing apparatus utilized in the implementation of a difference engine hybrid game in accordance with an embodiment of the invention.

Any of a variety of processing apparatuses can host various components of a difference engine hybrid game in accordance with embodiments of the invention. In several embodiments, these processing apparatuses can include, but are not limited to, a video gaming console, a gaming machine, a general purpose computer, a computing device, a controller and/or a mobile computing device, such as a tablet computer, a personal data assistant, or a smartphone. A processing apparatus that is constructed to implement a difference engine hybrid game in accordance with an embodiment of the invention is illustrated in FIG. 14. In the processing apparatus 1500, a processor 1504 is coupled to a memory 1506 by a bus 1528. The processor 1504 is also coupled to non-transitory processor-readable storage media, such as a storage device 1508 that stores processor-executable instructions 1512 and data 1510 through the system bus 1528 to an I/O bus 1526 through a storage controller 1518. The processor 1504 is also coupled to one or more interfaces that can be used to connect the processor to other processing apparatuses as well as networks as described herein. The processor 1504 is also coupled via the bus to user input devices 1514, such as tactile devices including but not limited to keyboards, keypads, foot pads, touch screens, and/or trackballs, as well as non-contact devices such as audio input devices, motion sensors and motion capture devices that the processing apparatus can use to receive inputs from a user when the user interacts with the processing apparatus. The processor 1504 is connected to these user input devices 1514 through the system bus 1528, to the I/O bus 1526 and through the input controller 1520. The processor 1504 is also coupled via the bus to user output devices 1516 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1528 to the I/O bus 1526 and through the output controller 1522. The processor 1504 can also be connected to a communications interface 1502 from the system bus 1528 to the I/O bus 1526 through a communications controller 1524.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or can be implemented on a single processing apparatus. In addition, while certain aspects and features of difference engine processes described herein have been attributed to an RWE, GWE, or ESE, these aspects and features can be implemented in a hybrid form where any of the features or aspects can be performed by any of a RWE, GWE, ESE within a difference engine hybrid game without deviating from the spirit of the invention.

While the above description contains many specific embodiments of the invention, these should not be construed as limitations on the scope of the invention, but rather as an example of one embodiment thereof. It is therefore to be understood that the present invention can be practiced otherwise than specifically described, without departing from the scope and spirit of the present invention. Thus, embodiments of the present invention should be considered in all respects as illustrative and not restrictive.

What is claimed is:

1. An electromechanical gaming machine constructed to receive real world credits, comprising:

an entertainment software engine connected to a game world engine, wherein the entertainment software engine is constructed to:

execute an entertainment game of skill using initial conditions generated by the game world engine;

generate an actual entertainment game outcome on the basis player actions;

generate a perceivable output of the entertainment game outcome on a user interface device;

a real world engine connected to the game world engine, wherein the real world engine is constructed to:

receive the real world credits from a portable media, wherein the portable media includes at least one member of a group including a voucher, a smart card, and currency;

store the real world credits in a credit meter;

receive a trigger for a wager to determine the initial conditions of the entertainment game;

determine a randomly generated outcome using a random number generator;

distribute the randomly generated outcome to the game world engine;

receive a determined paytable from the game world engine;

augment or decrement the real world credits stored in the credit meter on the basis of the determined paytable and the randomly generated outcome;

and the game world engine connected to the entertainment software engine and the real world engine, wherein the game world engine is constructed to:

request the randomly generated outcome from the real world engine;

generate the initial conditions for the entertainment game using the randomly generated outcome;

distribute the initial conditions for the entertainment game to the entertainment software engine;

calculate an optimal entertainment game outcome based on the initial conditions for the entertainment game;

determine an amount of game world credits awarded to the player on the basis the entertainment game outcome;

compare the optimal entertainment game outcome to the actual entertainment game outcome using Euclidian distance;

determine the paytable from among a plurality of paytables;

and add to the entertainment game, using the randomly generated outcome, one or more additional elements of the entertainment game to be acted upon by the player.

2. The electromechanical gaming machine of claim 1, wherein the optimal entertainment game outcome is modified by a standard of player performance for a plurality of players.

3. The electromechanical gaming machine of claim 1, wherein the optimal entertainment game outcome is measured by an amount of game world credit.

4. The electromechanical gaming machine of claim 1, wherein the entertainment software engine, the real world engine and the game world engine are constructed using a same processing apparatus.

5. The electromechanical gaming machine of claim 1, wherein the entertainment software engine, the real world engine and the game world engine are constructed using different processing apparatuses.

6. The electromechanical gaming machine of claim 1, further comprising:

an enclosure constructed to mount:

a user input device operatively connected to the game world engine;

a user output device operatively connected to the game world engine;

a credit input device operatively connected to the real world engine; and a credit output device operatively connected to the real world engine.

7. The electromechanical gaming machine of claim 6, further comprising a regulated random number generator, wherein the real world engine is further constructed to:

communicate with the credit input device to receive a credit input;

generate a random outcome using the regulated random number generator; and update a credit meter based on the event outcome.

* * * * *